US008585846B2

(12) United States Patent
Gelli et al.

(10) Patent No.: US 8,585,846 B2
(45) Date of Patent: Nov. 19, 2013

(54) METHOD AND DEVICE FOR CLOSING THE TAIL END OF A LOG OF WEB MATERIAL AND LOG OBTAINED

(75) Inventors: Mauro Gelli, Lucca (IT); Romano Maddaleni, Pisa (IT); Graziano Mazzaccherini, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 187 days.

(21) Appl. No.: 12/450,770

(22) PCT Filed: Apr. 11, 2008

(86) PCT No.: PCT/IT2008/000236

§ 371 (c)(1),
(2), (4) Date: Oct. 27, 2009

(87) PCT Pub. No.: WO2008/126122

PCT Pub. Date: Oct. 23, 2008

(65) Prior Publication Data

US 2010/0101705 A1 Apr. 29, 2010

(30) Foreign Application Priority Data

Apr. 13, 2007 (IT) ..... FI2007A0087

(51) Int. Cl.

| | |
|---|---|
| ***B29C 65/00*** | (2006.01) |
| ***B29C 70/34*** | (2006.01) |
| ***B32B 37/00*** | (2006.01) |
| ***B65C 3/12*** | (2006.01) |
| ***B65C 3/16*** | (2006.01) |
| ***B65C 9/04*** | (2006.01) |
| ***B65C 9/28*** | (2006.01) |
| ***B65H 81/00*** | (2006.01) |
| ***B05C 1/00*** | (2006.01) |

(52) U.S. Cl.

USPC ..... 156/152; 156/357; 156/184; 156/361; 156/456; 156/187; 156/446; 156/449; 156/443; 156/191; 156/444; 118/243

(58) Field of Classification Search

USPC ..... 156/357, 184, 361, 456, 187, 446, 449, 156/443, 191, 444; 118/243

See application file for complete search history.

(56) References Cited

U.S. PATENT DOCUMENTS

| | | | | |
|---|---|---|---|---|
| 3,898,920 | A * | 8/1975 | Zucker | 493/394 |
| 3,960,272 | A | 6/1976 | Hartbauer et al. | |
| 4,332,324 | A | 6/1982 | Howard et al. | |
| 5,242,525 | A | 9/1993 | Biagiotti | |
| 5,259,910 | A | 11/1993 | Biagiotti | |
| 5,681,421 | A | 10/1997 | Biagiotti | |
| 5,716,489 | A | 2/1998 | Biagiotti | |
| 6,050,519 | A | 4/2000 | Biagiotti | |
| 6,682,623 | B1 | 1/2004 | Biagiotti | |
| 2005/0258298 | A1 | 11/2005 | Maddaleni et al. | |

FOREIGN PATENT DOCUMENTS

| | | | |
|---|---|---|---|
| DE | 26 27 558 | A1 | 12/1977 |
| DE | 195 28 264 | A1 | 4/1996 |
| EP | 0 592 375 | A1 | 4/1994 |
| GB | 1009697 | | 11/1965 |

(Continued)

*Primary Examiner* — Christopher Schatz
*Assistant Examiner* — Matthew Hoover
(74) *Attorney, Agent, or Firm* — Breiner & Breiner, L.L.C.

(57) ABSTRACT

To close the tail end (L) of the web material forming the log (R) there is provided mechanical ply-bonding between the tail end and a portion of the last turn of web material, preferably a portion forming a fold (F) projecting from the log.

26 Claims, 18 Drawing Sheets

(56) References Cited

FOREIGN PATENT DOCUMENTS

| | | | |
|---|---|---|---|
| WO | WO 2004/046006 | A2 | 6/2004 |
| WO | WO 2004/046006 | A3 | 6/2004 |
| WO | WO 2006/070431 | A1 | 7/2006 |
| WO | WO 2006/092818 | A1 | 9/2006 |

* cited by examiner

METHOD AND DEVICE FOR CLOSING THE TAIL END OF A LOG OF WEB MATERIAL AND LOG OBTAINED

TECHNICAL FIELD

The present invention relates to methods and machines for processing web materials. More in particular, the present invention relates to methods and machines intended to close, i.e. to fasten to the log, the tail end or edge of a log of web material, such as paper, in particular tissue paper, plastic, nonwoven or other material intended to be packaged in rolls.

STATE OF THE ART

In the paper converting industry, in particular but not exclusively in the tissue paper converting industry, for the production of rolls of toilet paper, kitchen towels and the like, logs containing a predetermined quantity of a wound web material are produced in rapid sequence by rewinding machines. These logs usually have a much greater axial length than the length, of the finished products, typically rolls of toilet paper or kitchen towels. The logs thus produced must therefore be handled further to be cut into rolls of smaller length and then packaged in packs of plastic film, paper, cardboard or the like. These handling operations require the tail end of the log to be stably fastened to the log, to prevent accidental unwinding of the web material, both during the steps to cut it into rolls and during the subsequent packaging steps.

For this purpose different machines have been developed, the function of which is to close the tail end of the logs. In the most modern machines for performing this operation the logs delivered from the rewinding machine are made to roll along a surface provided with a slot, through which a glue is dispensed onto a portion of the substantially cylindrical surface of the log, having previously unwound a length or portion of web material. By continuing to roll along said surface the log is rewound and the tail end covers the line of glue applied as a result of rolling over the dispensing slot. Machines of this type are described in U.S. Pat. Nos. 5,242,525, 5,259,910, 5,716,489, 5,681,421.

U.S. Pat. No. 6,050,519 discloses a rewinding machine in which the system for gluing the tail end described above is incorporated in this rewinding machine.

U.S. Pat. No. 6,682,623 discloses a machine for gluing the tail end suitable to function according to different principles on the basis of the dimensions of the log to be glued.

WO-A-2006/070431 discloses a machine for gluing the tail end of a log, in which this tail end is folded to improve gripping thereof by the final user wishing to open a new roll.

US-A-2005/258298 discloses a rewinding machine in which a system for distributing glue on the winding cores is used to transfer a part of the glue applied to the core to the web material in the area in which the tail end of the previously wound log will be generated.

WO-A-2004/046006 discloses another type of rewinding machine in which it is possible to apply a glue to the end area of the web material which, after winding of the log is completed, will form the tail end thereof.

All the systems currently known and described above, and many other known to those skilled in the art of paper converting, involve the use of a glue to close or seal the tail end of the web material of the logs.

The use of glues in these machines represents a cost and is the origin of considerable drawbacks in production lines due to the fact that the glue soils the machines and, when they are stopped, tends to dry, thus making frequent maintenance and cleaning operations necessary.

Moreover, gluing of the tail end frequently causes seepage of glue toward the inner turns of the log, so that when a final user opens a roll a certain number of turns, some times a considerable number, are broken and consequently wasted. To prevent this drawback it is necessary to carefully regulate the gluing devices and to use glues of suitable quality, but these circumstances do not always take place and in any case adversely affect the cost of the final product.

GB-A-1,009,697 discloses a method and a device that fastens the tail end of a log of web material without glue. This system provides for application of a liquid, for example water, to the wound log and embossing with a punch that acts orthogonally to the log, at the tail end on the area in which the liquid was applied. The combination of the embossing pressure and of the liquid causes ply-bonding between the tail end and a plurality of underlying layers, i.e. turns, of web material. This system is ineffective as fastening is not reliable, as it is impossible to apply sufficient pressure to the web material without damaging the log. Moreover, it requires a complex device, which besides requiring a liquid applicator, must also be provided with a heating system to dry the material after embossing. Moreover, as the punch must exert a certain pressure to secure the plies, the logs undergo deformation and even collapse of the central supporting core, with consequent loss of the cylindrical shape of these logs.

OBJECTS AND SUMMARY OF THE INVENTION

According to one aspect, the present invention proposes a method and a device that allows the drawbacks described above to be completely or partly solved.

According to a particular aspect, the invention suggests a method and a device that allow closing of the tail end of a log of wound web material, typically and preferably, but not exclusively, tissue paper, without the use of glue.

In substance, in one embodiment, the invention provides for a method to close the tail end of a log of web material wherein the tail end is secured to the log with mechanical ply-bonding. In an embodiment, the tail end is fastened mechanically to a portion of web material of the outermost turn of the log.

Mechanical fastening is intended as a fastening obtained prevalently through mechanical members.

Mechanical ply-bonding of layers or sheets or plies of paper is known. This technique is based on the fact that by superimposing two plies or layers of web material, made in particular of fibrous material, such as tissue paper or the like, and by subjecting these two layers to a high localized compression force, they are joined through a sort of localized bonding of the fibers. A mechanical ply-bonding system of plies is disclosed, for example, in EP-A-0592375. WO-A-2006/092818 discloses a mechanical ply-bonding system, in which ply-bonding is made simple and more effective through prior moistening of the plies to be joined.

However, to date the mechanical ply-bonding technique has only been used to mutually join two plies of web material fed continuously through a machine, for example through a rewinding machine or through an embossing unit. In substance, mechanical ply-bonding has been used to form a continuous multi-layer product.

The present invention, instead, is based on the innovative idea of using mechanical ply-bonding to fasten the tail end of a log to a portion of material wound on said log, so that said tail end does not become unwound in the subsequent processing operations, preferably until packaging of the finished product.

In one advantageous embodiment of the invention, the tail end is mechanically fastened to a portion of the outermost turn of web material, said portion having been previously folded to form an area of web material projecting with respect to the finished log. This allows the tail end to be fastened reliably to an intermediate portion of web material of the last wound turn, without damaging the material of the inner turns of the log.

By generating a projecting portion of web material, for example by folding two transverse portions of the web material, it is possible to fasten the tail end to the two folded transverse portions of said material, in substance compressing a triple layer of web material with a high pressure, sufficient to join the layers.

In this way it is possible to apply very high pressures without any risk of damaging the material of the log. Moreover, in the finished product an end of material remains projecting from the log, which facilitates opening of the roll by the user. This avoids the difficulties often encountered in detaching the tail end glued with conventional systems. The transverse fold projecting from the material wound in a log, and to which the tail end is fastened, also prevents accidental and unwanted junction or reciprocal bonding of several superposed turns of the web material. In fact, only the last turn of the material forming the log is involved in the log sealing operation and only this length of material is in some way damaged by said operation. Moreover, the absence of glue makes this first portion of web material also usable, while in conventional logs the glued part of the roll is normally discarded by the user.

In a modified embodiment, fastening is obtained using perforators of suitable shape, such as toothed needles or the like, to perforate the portions of web material that must be mutually mechanically fastened.

In a particular embodiment the method comprises the steps of:

a) unwinding a length of web material from a log;
b) forming a fold in the web material at a distance from the tail end approximately equal to the circumferential extension of the log;
c) joining the tail end to said fold, which projects from the surface of the log.

In a modified embodiment, the method provides for the steps of:

a) unwinding a length of web material from a log;
b) loosening the last turn of material wound on said log to form a fold projecting from the log, positioned along said turn so that between said fold and said tail end there is a length of web material approximately corresponding to the circumferential extension of said log;
c) joining the tail end to said fold.

In a further modified embodiment, the method comprises the steps of:

a) unwinding a length of web material from a log;
b) at a distance from the tail end approximately equal to the circumferential extension of said log, forming a fold in said length of web material unwound from the log;
c) rewinding said length of web material around the log, so that said fold projects from the surface of the log and is carried adjacent to said tail end;
d) joining the tail end to said fold.

Further features and embodiments of the method according to the invention are defined in the dependent claims and will be described in further detail below with reference to a method of implementation.

According to a further aspect, the invention relates to a device to close the tail end of a log of wound web material, typically a log of tissue paper, comprising a mechanical ply-bonding member arranged and controlled to mechanically join the tail end to a portion of the web material of the log, preferably a portion of the outermost turn of the log.

In one embodiment, the device comprises unwinding members to unwind a portion of web material from the log. In one embodiment, the device comprises a folding device to form a transverse fold in the length of the web material unwound from the log. The mechanical ply-bonding member is arranged and designed to perform mechanical ply-bonding between the folded material and the tail end of the web material.

In one embodiment the device according to the invention has a stabilization member to stabilize the fold formed by the folding device. In an implementation, the member to stabilize the fold can have mechanical stabilization elements, which mutually join through mechanical ply-bonding the two superposed portions of the web material at the two sides of the folding line. Mechanical stabilization can take place through a perforation system with suitably shaped needles.

In one embodiment of the invention, stabilization of the portions of folded web material takes place as a result of a localized compression, or by localized bonding of the fibers forming two opposed portions of folded web material.

In one embodiment the fold is formed with the aid of a pneumatic system. The pneumatic system can have a suction system, a blowing system or a combined suction and blowing system. In a modified embodiment, the fold can be formed with the aid of an electrostatic system, with a mechanical folding system or in another suitable way, although the pneumatic system has considerable advantages in terms of effectiveness and rapidity.

In one possible embodiment, the device comprises an unwinding surface, along which a portion or length of web material is unwound. The fold is formed in a suitable position along this length of unwound material. The folding device is located in a suitable position with respect to the unwinding surface.

In one embodiment the unwinding surface can be formed of movable members, for example a continuous flexible member such as a belt or mat, or even a series of parallel belts. A suction system, for example a suction box, can be provided to hold the length of web material that is unwound from the log in a spread out position to perform the transverse fold. The unwinding surface can be defined along more than one movable flexible member, for example along two continuous movable flexible members, composed of groups of parallel belts or other equivalent means. In one embodiment, a suction box is associated with some or with each of the continuous movable flexible members. In this way, successive lengths of a path of the logs are defined, in which it is possible to control several logs that advance in succession in an optimal manner. Above the unwinding surface an upper continuous flexible member or a series of two or more upper continuous flexible members can be arranged, which contribute to controlling the forward, unwinding and/or rewinding movement of the logs.

The invention also relates to a log obtained with the method described above.

Further advantageous characteristics and embodiments of the device according to the invention are indicated in the appended claims and will be described below in greater detail with reference to a non-limiting embodiment of the invention.

BRIEF DESCRIPTION OF THE DRAWINGS

The invention will be better understood by following the description and accompanying drawing, which shows a non-limiting embodiment of the invention. More specifically, in the drawing:

FIG. 2 shows an enlargement of the device of FIG. 1 in the fold forming area;

DETAILED DESCRIPTION OF AN EMBODIMENT OF THE INVENTION

Figure 1:
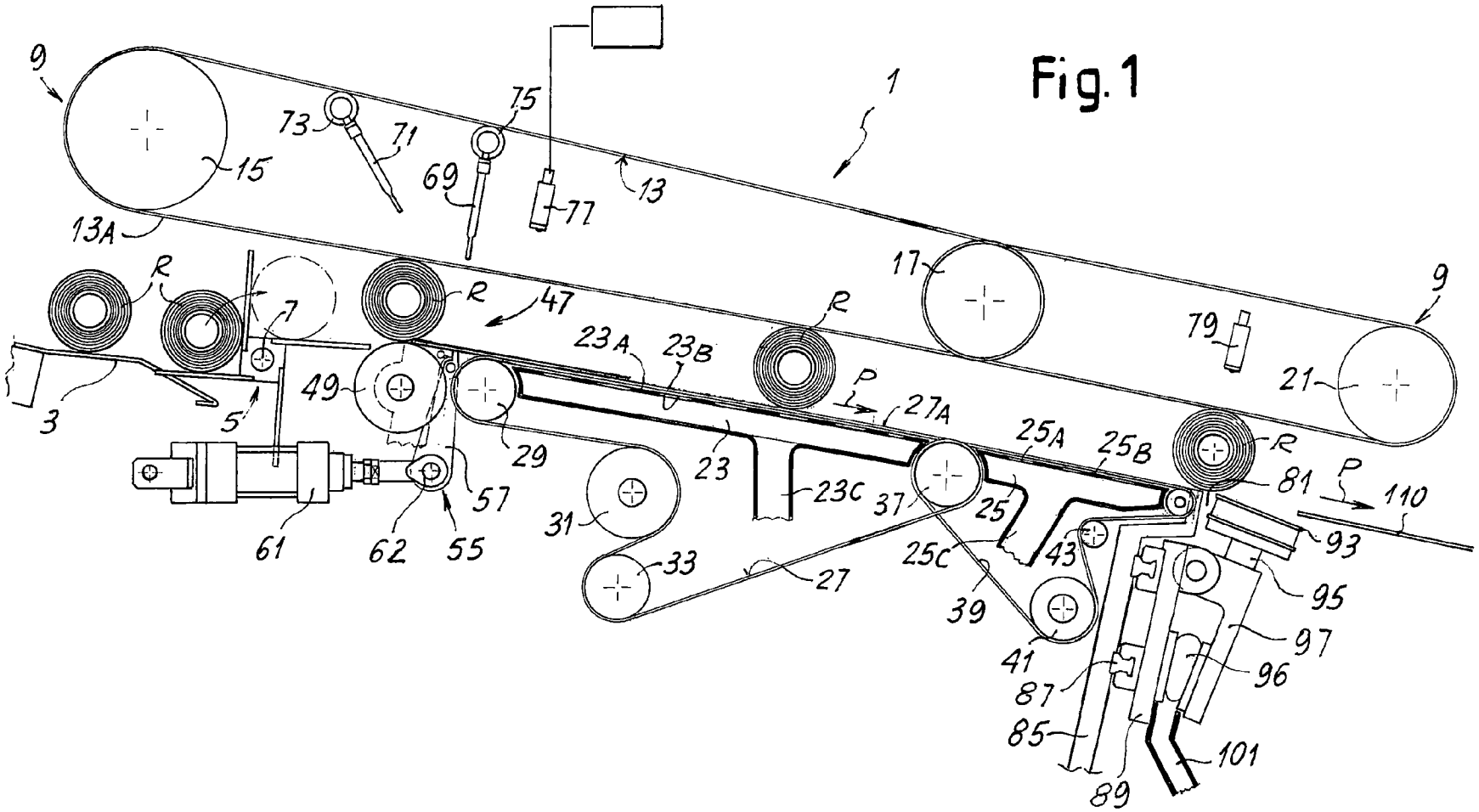
FIG. 1 shows a schematic side view of a device according to the invention in a first embodiment.
Figure 3:
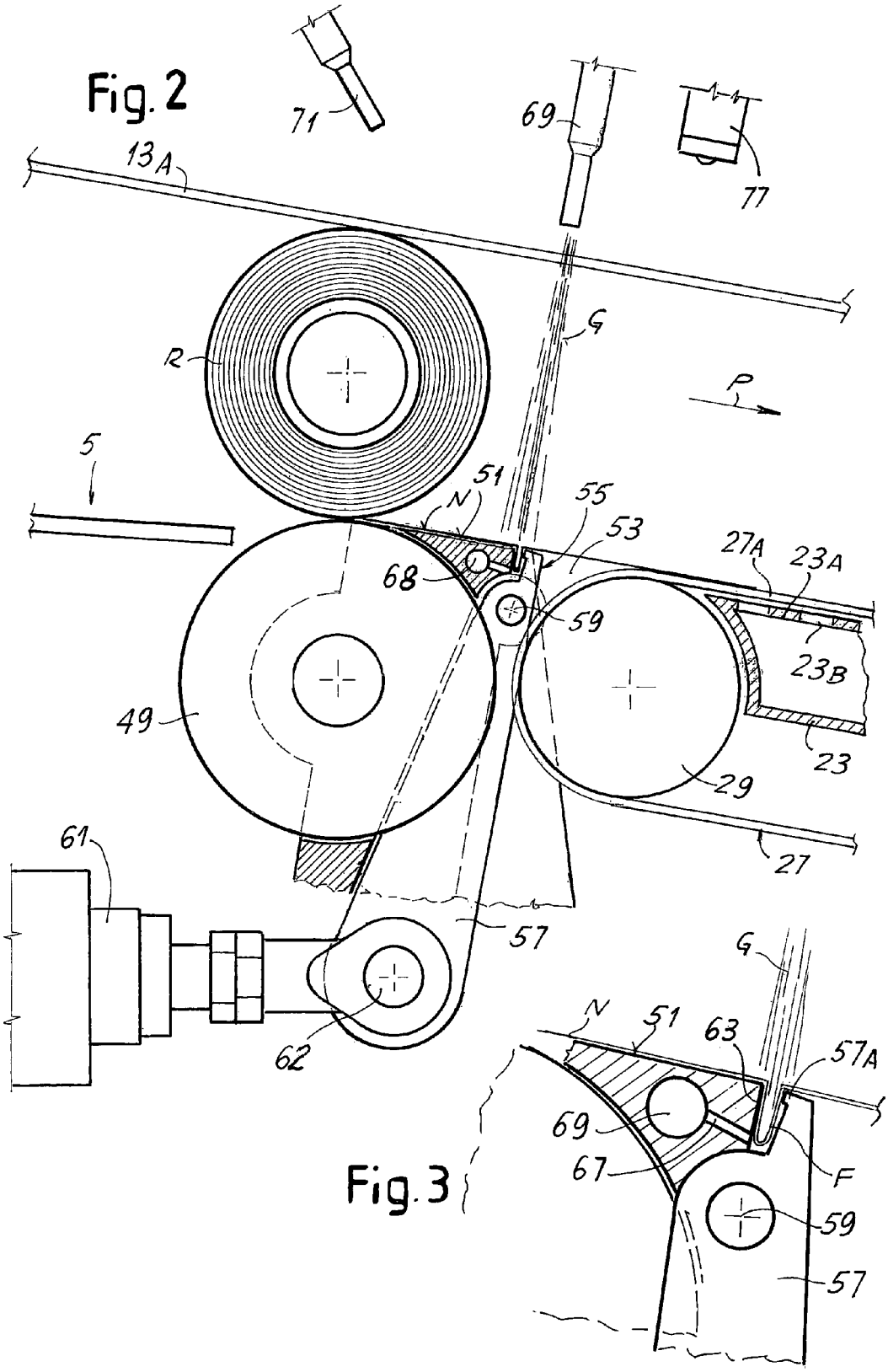
FIG. 3 shows a further enlarged detail of FIG. 2.

With reference to the figures, the number 1 indicates as a whole a machine for closing the tail end of a web material, typically tissue paper, implementing the invention.

In one embodiment, the machine 1 comprises a feed chute 3, along which logs R are discharged from a rewinding machine, from an intermediate buffer, or from any other unit upstream along the converting line. Downstream of the chute 3 there is disposed a distributor 5 rotating about an axis 7, which individually picks up single logs R to feed them into a path P along which these logs are subjected to a series of operations to obtain closing of the tail end of these logs.

In one embodiment, the path P extends between an upper movement member indicated as a whole with 9 and a lower surface or lower structure, on which the logs are supported, indicated as a whole with 11.

In one embodiment, the upper movement member 9 comprises a first flexible member 13 driven around a first driving member 15 and a second driving member 17. The continuous flexible member 13 can be composed of a series of parallel belts, spaced apart from one another, each of which is driven around respective pulleys. The first driving member 15 can be comprised of a series of coaxial pulleys and the second driving member 17 can be similar. The driving members 15, 17, around which the belts or other elements forming the flexible member 13 are driven, can both be motorized or preferably only one of them is motorized and the other is idle. In a possible embodiment, the driving member 15 is motorized while the driving member 17 is idle and is drawn in rotation by the continuous flexible member 13.

In one embodiment the upper handling member 9 comprises a further flexible member 19, which can also be comprised of a series of parallel belts. The belts 19 are driven around the driving member 17 and around a further driving member 21.

In a possible embodiment, there are provided coaxial pulleys 17 independent from each other and mounted idle on a common axis, while each of the two driving members 15 and 21 is comprised of respective groups of pulleys keyed on a motorized shaft. In this way the flexible member 13 and the flexible member 19 can be moved independently from each other and perform different movements in different times and at variable speeds independently from each other.

In a possible embodiment the lower supporting structure 11 of the logs comprises a first suction box 23 and a second suction box 25 arranged in series along the feed path P of the logs R. In one embodiment the suction box 23 has a substantially flat upper wall 23A perforated with holes 23B through which air can be sucked. The reference 23C indicates a duct for connection to a suction line.

In one embodiment the suction box 25 is delimited at the top by a substantially flat wall 25A with suction holes 25B through which air is sucked. The inside of the suction box 25 is connected to a suction line through a duct 25C. The suction line to which the ducts 23C and 25C are connected can be the same.

Along the substantially flat upper wall 23A of the suction box 23 there extends the upper branch of a continuous flexible member 27, which can be comprised of a series of parallel belts or the like. The flexible member 27 is driven around driving members 29, 31, 33, 37. These driving members, analogously to the driving members 15, 17 and 21, can be comprised of rollers or of groups of coaxial pulleys.

In one embodiment of the invention the driving member 31, for example a roller or an assembly of coaxial parallel pulleys keyed on a common shaft, is motorized, while the driving members 29, 33 and 37 are idle.

The reference 27A indicates the upper branch of the flexible member 27. This upper branch runs along the outer surface of the wall 23A of the suction box 23.

With an arrangement similar to the one described with reference to the flexible member 27, a further flexible member 39 has an upper branch 39A sliding along the outer surface of the substantially flat upper wall 25A of the suction box 25. The continuous flexible member 39, which in the same manner as the flexible member 27 can be a system of parallel belts or the like, is driven around the driving member 37 and around further driving members 41, 43, 45. Just as for the driving member 37, the driving members 41, 43, 45 can also be of various types, such as rollers or cylinders or assemblies of coaxial pulleys.

Just as for the assembly of pulleys 17, the assembly of pulleys 37 can also preferably be mounted idle independently from one another on a common axis, to allow an independent movement of the flexible member 27 with respect to the flexible member 39. The latter is moved by one or more driving members, for example a roller 41 which can be motorized.

In one embodiment, upstream of the suction box 23 an unwinding member 47 is arranged. In one embodiment, the unwinding member 47 can comprise one or more belts in contact with the log to be unwound. In a different embodiment, shown in the figure, the unwinding member 47 comprises a motorized roller 49, cooperating with the continuous flexible member 13 and placed at a distance from the lower branch 13A thereof approximately equal to or slightly less than the diameter of the logs R.

In one embodiment, the upper movement member 9 can be adjustable in height to modify the distance between the lower branch 13A of the flexible member 13 and the motorized roller 49 adjusting the machine to the different diameters of the logs R.

Between the roller 49 and the driving member 29 an opening, space or cavity is provided that extends under a geometrical surface represented by the extension of the substantially flat upper wall 23A of the suction box 23 and by a surface 51 tangent to the roller 49.

In said opening, cavity or space, indicated with 53, which extends transversely with respect to the direction of advance of the logs along the path P, there is housed a pressure member that forms a member for stabilization of a fold produced, in the manner to be described below, in an area or length of web material unwound from each log R that is fed to the machine 1. In one embodiment, the pressure member indicated as a whole with 55, comprises a series of levers or oscillating arms 57 pivoted about a common axis 59 substantially transverse with respect to the direction of advance of the logs R. The reference 61 indicates an actuator, for example a piston-cylinder actuator, which controls oscillation of the arms 57, which can be joined by a common axis 62 to which the actuator 61 is pivoted. In one embodiment, there are provided two or more actuators 61 at the ends or in various points distributed along the extension of the axis 62 to apply sufficient stress on the arms 57. As shown in the drawing, the pivot axis 59 of the arms 57 is placed so that the distance between the upper free end 57A of each arm 57 is arranged at a distance from the axis 59 substantially less than the distance between the axes 59 and 62. In this way the arms 57 form levers, which with a moderate force applied by the actuators 61, through the end 57A exert an extremely high pressure against a pressure surface or counter surface 63 provided for example on a transverse block that delimits the cavity or transverse space 53 and that defines the surface 51.

Under the pressure or counter surface 63 with which the ends 57A of the oscillating arms 57 cooperate, suction holes 67 open, preferably distributed along the entire width of the machine, i.e. along the entire transverse extension of the cavity or space 53 under the surface 51. The ducts 67 are connected to a suction compartment or collector 68, so that suction is created adjacent to the surface 63 to suck a portion of web material between the counter surface 63 and the ends 57A of the arms 57 for purposes that will be explained below.

The effect of suction through the holes 67 can be replaced by or combined with the effect of jets of compressed air G generated by nozzles 69 arranged between the upper branch and the lower branch of the continuous flexible member 13. The nozzles 69 are oriented toward the cavity defined between the counter surfaces 63 and the ends 57A of the oscillating arms 57. Preferably, several nozzles 69 are aligned transversely for part or for the entire transverse extension of the machine.

In one embodiment, between the upper and lower branches of the continuous flexible member 13 a second series of compressed air nozzles 71 is disposed. These are connected to a compressed air duct 73, similarly to the nozzles 69 that are connected to a compressed air duct 75. In a modified embodiment the nozzles 71 and 69 can be connected to a same compressed air supply duct. The nozzles 71 are slanted with respect to the lower branch 13A of the continuous flexible member 13 and more exactly they are inclined so that the air jets G2 generated thereby are directed with a component in the direction of advance of the logs R along the path P.

In one embodiment, between the upper and lower branches of the continuous flexible member 13 arranged a sensor is also, for example a photocell 7 arranged to detect the presence of a tail end L of web material N in a specific position, for example along the upper branch 27A of the continuous flexible member 27.

In one embodiment, a further sensor 79, also for example an optical sensor, is arranged between the upper and lower branches of the flexible member 19. The sensor 79 is positioned so as to detect the presence of a tail end of web material approximately at the driving member 45 of the continuous flexible member 39.

In one embodiment, downstream of the driving member 45 a cavity, space or compartment 81 is provided, extending below an ideal geometrical surface forming the extension of the upper branch 39A of the continuous flexible member 39. This cavity or space 81 is delimited upstream by a crossbar 83 that can be fixed, for example, to a structure or fixed frame 85. The structure 85 is produced to intercalate; for example, between the parallel belts defining the continuous flexible member 39. The suction box 25 can be shaped so as to allow housing of a comb structure of the frame 85.

In one embodiment, guides 87 are fixed to the load bearing structure or frame 85, along which a carriage 89 carrying a ply-bonding wheel 91 runs. The wheel 91 can have an annular edge 93 that cooperates with the crossbar 83 pressing against it while the wheel 91 performs a movement along the guides 87 by means of the carriage or slide 89. Reference number 96 indicates an actuator, for example a Torpress, that stresses the wheel 91 with the annular edge thereof 93 against the surface defined by the crossbar 83. For this purpose, in one embodiment the wheel 91 is supported idle on a shaft 95 integral with a bracket 97 oscillating about a pivot 99.

The movement of the carriage or slide 89 along the guides 87 is controlled by a screw-nut screw system or in another suitable way, not shown.

Under the space or compartment 81 a suction system is arranged, generically indicated with 101 which, for the purposes illustrated below, generates a flow of air that sucks the tail end L of the log and the transverse intermediate fold that is created along the outermost turn of the wound web material under the rolling surface of the logs R, so that these portions of web material (the fold and the tail end) enter the compartment 81 and are positioned to be mutually joined by means of mechanical ply-bonding caused by the wheel 91.

Figure 5:
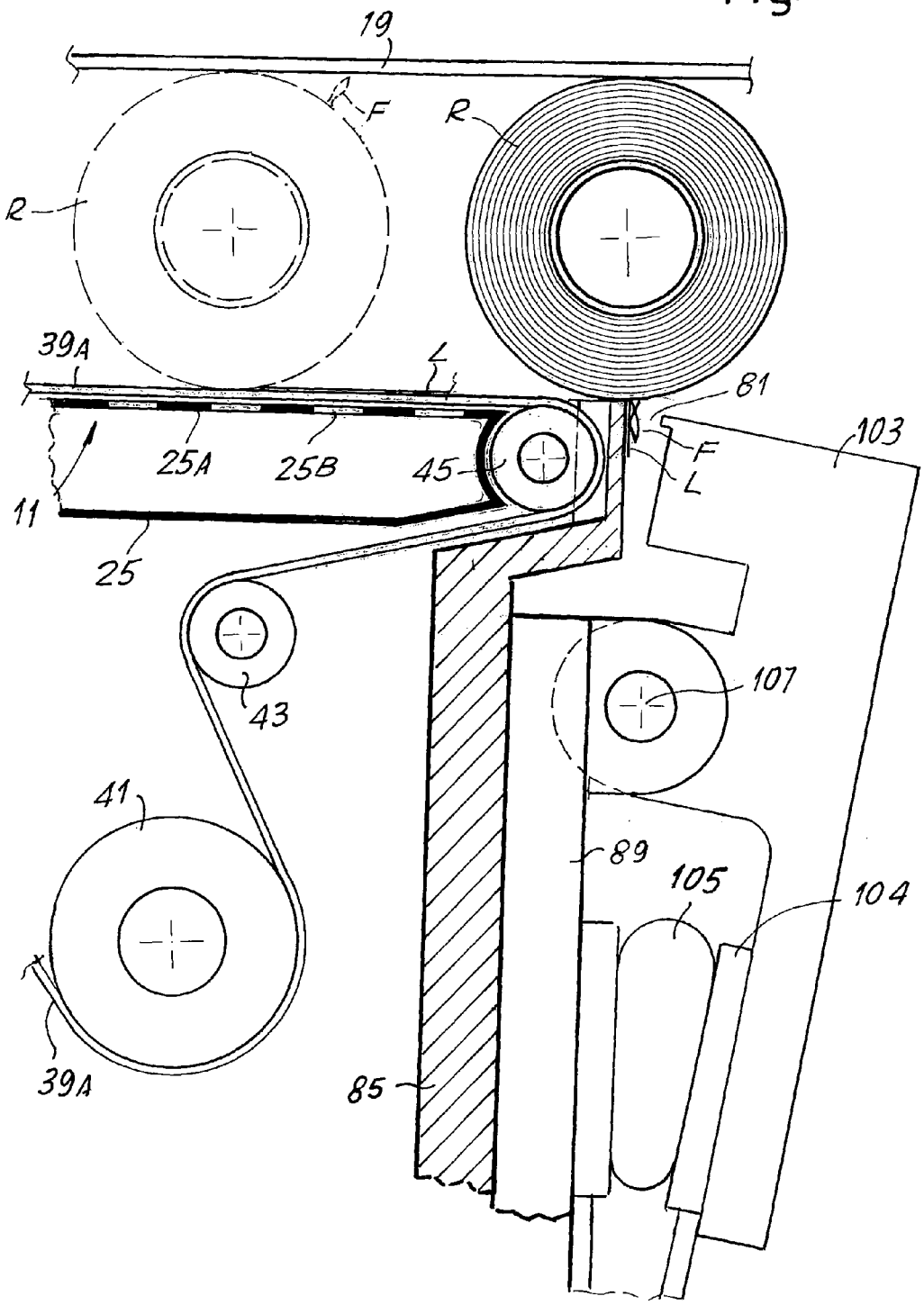
FIG. 5 shows an enlargement analogous to that of FIG. 4 in a modified embodiment.

In a modified embodiment, in place of the wheel 91 and of the members for movement thereof, there are provided oscillating arms 103 (see FIG. 5). The oscillating arms 103 substantially have a structure equivalent to that of the oscillating arms 57 and are controlled by an actuator such as a Torpress 105 or the like. The reference 107 indicates the oscillation axis of the arms 103. It would also be possible to use a single oscillating element 103. Alternatively, the mutually parallel arms 103 can be joined by a crossbar 104 on which the actuator 105 acts.

Operation of the machine described above is shown in detail in the sequence of FIGS. 6A-6J.

Initially, a log R coming from a machine upstream is picked up by the rotating distributor 5 from the chute 3 and is inserted between the lower motorized roller 49 and the lower branch 13A of the flexible member 13. The members 49 and 13 are carried in movement at substantially the same peripheral speed and in a direction so as to make the log R rotate in the direction of winding. As the roller 49 and the lower branch 13A of the flexible member 13 move at the same speed and in opposite directions in the contact points with the log R, the axis of the log R remains in a substantially fixed position while the log R rotates about this axis.

The nozzles 71 generate air jets G2 so that when the tail end L is in the area involved by the air jets G2 it is unwound and spread out on the unwinding surface below, defined by the upper branch 27A of the continuous flexible member 27 and by the upper wall 23A of the suction box 23, along which the upper branch 27A of the continuous flexible member 27 runs. A length of web material wound on the log R is then unwound and spread out under the sensor 77.

By continuing the rotational movement of the motorized roller 49 and the movement of the upper flexible member 13, the web material N is gradually rewound on the log R. As soon as the final edge of the tail end L is identified by the sensor 77, the latter generates a signal that is sent to a control unit 100, to which the various motors of the machine are connected and which controls them. As a result of this signal the movement of the motorized roller 49 and of the upper flexible member 13 is reversed, so that these two members now start to move again at a same speed but such as to make the log R rotate about its axis (which remains substantially in the same position) in the opposite direction to cause unwinding of the web material. In this step the lower flexible member 27 is also maintained in movement in the direction indicated in FIGS. 6A, 6B, so that a certain length of web material is unwound from the log R and spread out on the unwinding surface defined by the upper branch 27A of the lower flexible member 27 and by the upper wall 23A of the suction box 23. This unwinding step is interrupted when an adequate length of unwound web material is reached, slightly greater than the circumference of the log R. This length can be determined through a further optical sensor similar to the sensor 77 and positionable in an appropriate manner between the branches of the upper flexible member 13 along the path of the log R. In another embodiment (not shown) the amount of unwinding is controlled temporally, i.e. the movement of the roller 49, of the upper flexible member 13 and of the lower flexible member 27 are maintained for a time that, multiplied by the unwinding speed of the log R, gives the required unwound length. Alternatively, the unwound length can be determined through an encoder associated with one of the moving members 49, 13, 27. The signal of the optical sensor 77 provides the starting point for the measurement performed by the encoder or other position or movement sensor.

Upon reaching the length of the web material N required to be unwound, regardless of the method with which this is determined and controlled, the members 49 and 13 are stopped and the pneumatic system, composed of suction through the ducts 67 and/or of air jets through the nozzles 69, is activated to generate a fold F of web material under the surface 51, forming two transverse portions of web material disposed between the counter surface 63 and the ends 57A of the oscillating arms 57.

The suction and/or the air jets through the nozzles 69 can be maintained for the amount of time required to generate and stabilize the transverse fold F in the web material N. The fold is stabilized by oscillation the arms 57 through the actuators 61 so that the ends 57 of the arms 57 press with high localized pressure against the counter surface 63. The two portions of opposed web material that define the fold F are thus joined mechanically as a result of the high localized pressure exerted by the ends 57A of the arms 57. This operation stabilizes the fold.

Figure 4:
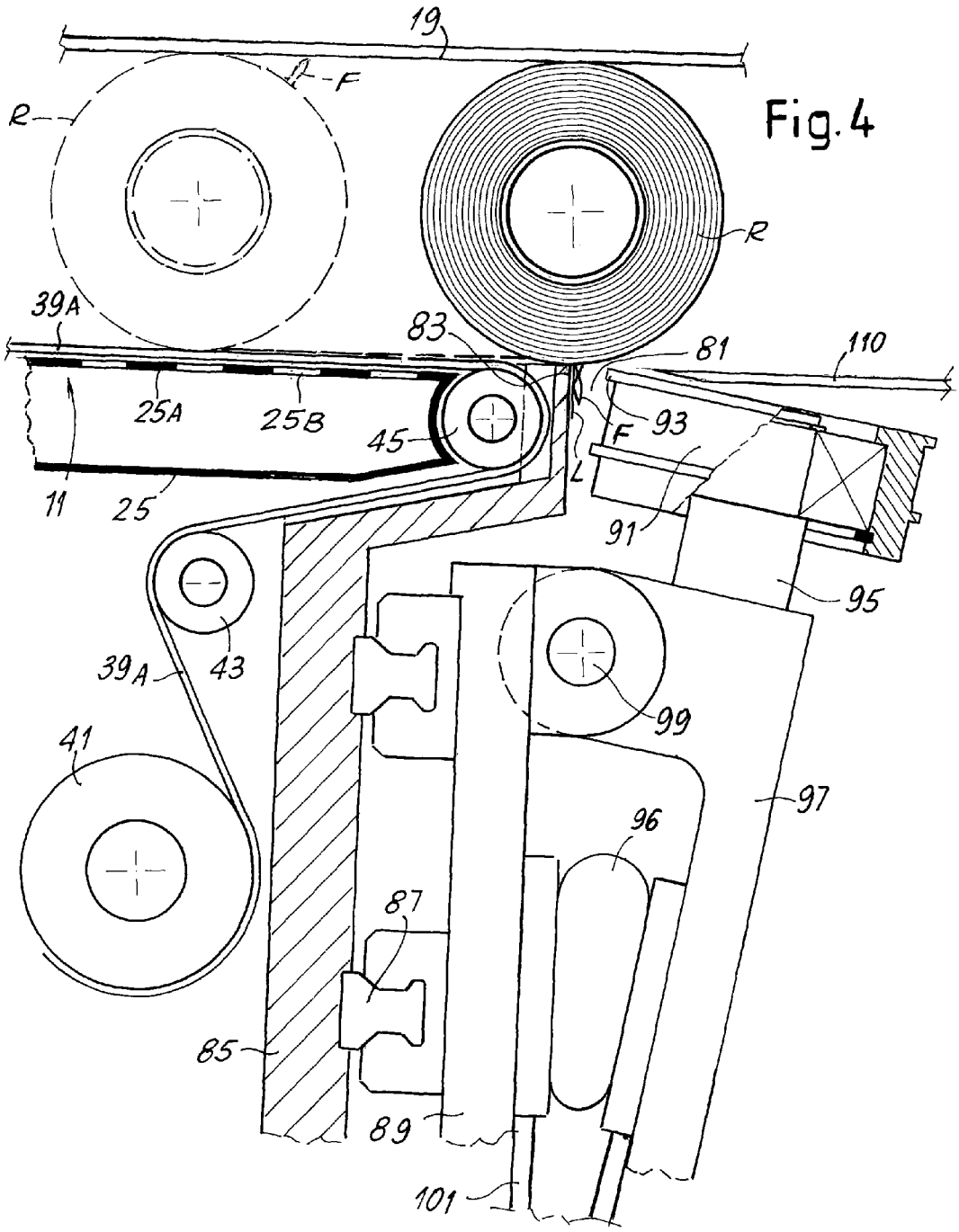
FIG. 4 shows an enlargement of the area for bonding the tail end to the fold formed in the web material.

It is understood that the oscillating arms 57 can in fact be composed of a single oscillating member advantageously having discontinuous ends 57A so as to reduce the contact surface between the pressure element 57 and the counter surface 63, so that with the same stress applied by the actuators 61 a very high localized pressure is obtained. In a modified embodiment, instead of discontinuous ends or protuberances 57A a continuous bar can be used, although in this case much higher stresses are required by the actuators 61. In a modified embodiment, bonding of the two strips or portions of web material defining the fold F can be obtained with a wheel analogous to the one indicated with 91 (see FIG. 4 and relative description).

In a modified embodiment, mechanical ply-bonding of the two opposed strips defining the fold F can take place with tips, needles, projections or the like that cause a perforation of the two strips. These members will be suitably shaped so that by entering and/or exiting from the web material they cause a breakage such as to obtain a localized bonding by means of tearing, perforation or other mechanical action on the web material N subjected to mechanical action.

In any case, at the end of this operation the transverse fold F generated in the web material N unwound from the log R is suitably stabilized so that subsequent rewinding will take place maintaining a fold projecting from the last turn of the web material.

In the subsequent step, the log R is advanced along the path P between the lower branch 13A of the upper member 13 and the lower suction box 23 and the upper branch 27A of the lower continuous flexible member 27 as a result of the movement of the flexible member 13 and of the lower continuous flexible member 27, while the roller 49 can be stopped, slowed or rotated in the opposite direction. The lower flexible member 27 can remain stopped but preferably moves to contribute to the advance of the log R along the path P with a translational and rolling movement on the lower unwinding surface defined by the branch 27A of the lower flexible member 27.

By modulating the speeds of the upper 13 and lower 27 continuous flexible members, the log R can be advanced causing gradual winding but still maintaining a length of unwound web material between the log and the tail end L so that by continuing to advance the log R is positioned over the suction box 25 between this and the upper flexible member 19 with the tail end L disposed approximately at the compartment 81, i.e. at or slightly downstream of the upper corner of the crossbar 83. This position is identified through an optical sensor 79. To reach this position, advance of the log along the path P is obtained, as well as with the movement of the upper flexible member 13 and of the lower flexible member 27, also with the movement of the upper flexible member 19 in combination with the movement of the lower flexible member 39 along the suction box 25.

Figure 6A:
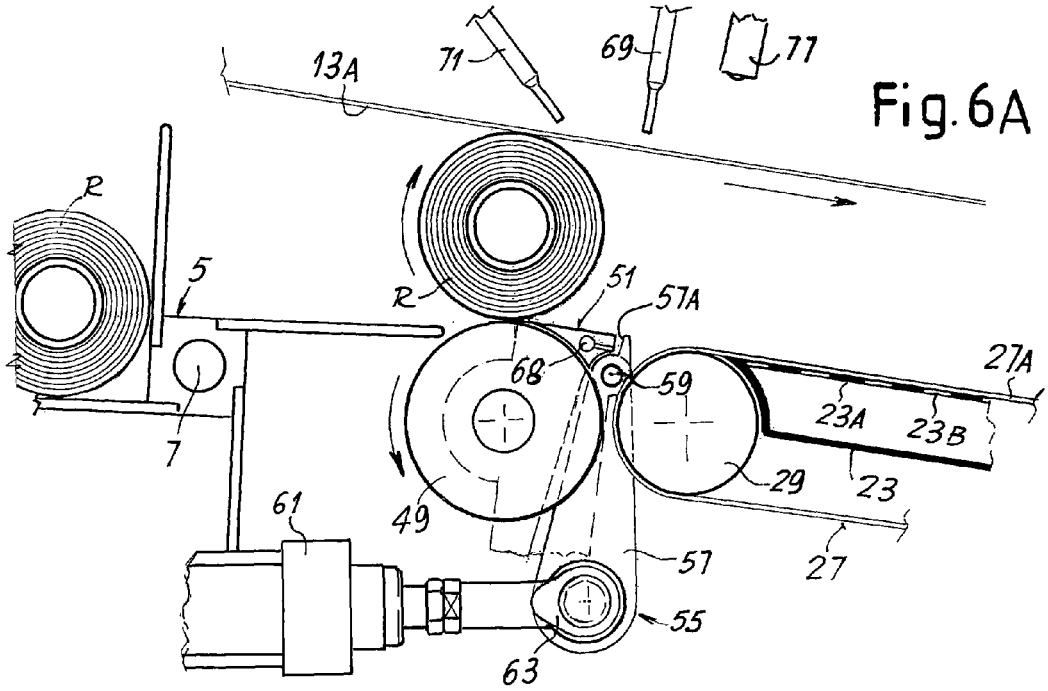
FIGS. 6A-6J show an operating sequence of the device of FIG. 1.
Figure 6B:
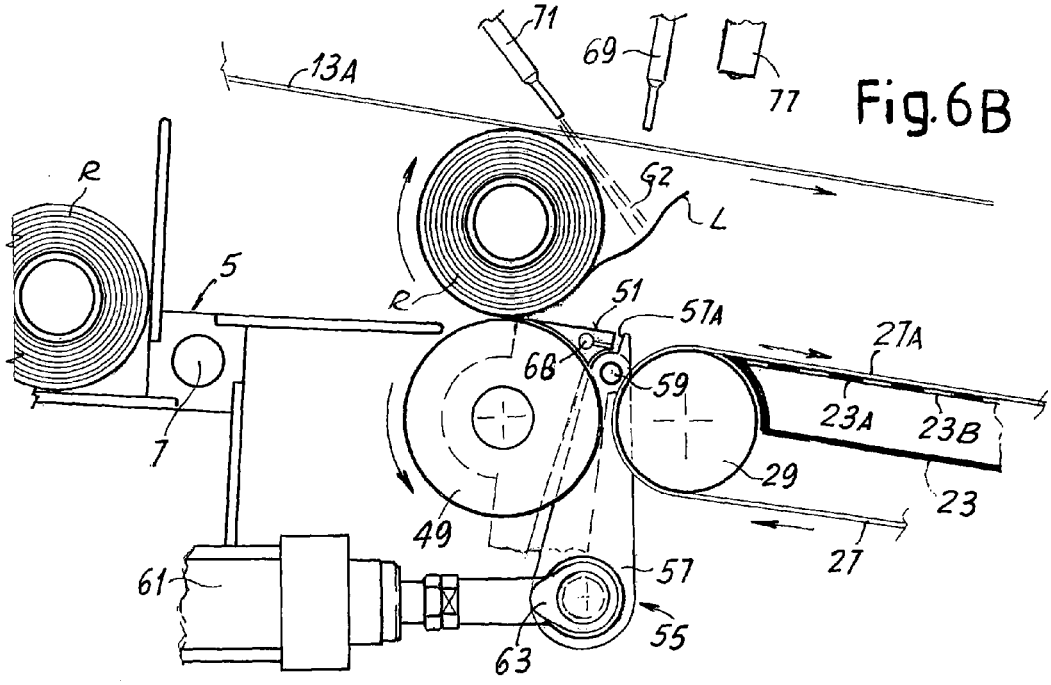
Figure 6C:
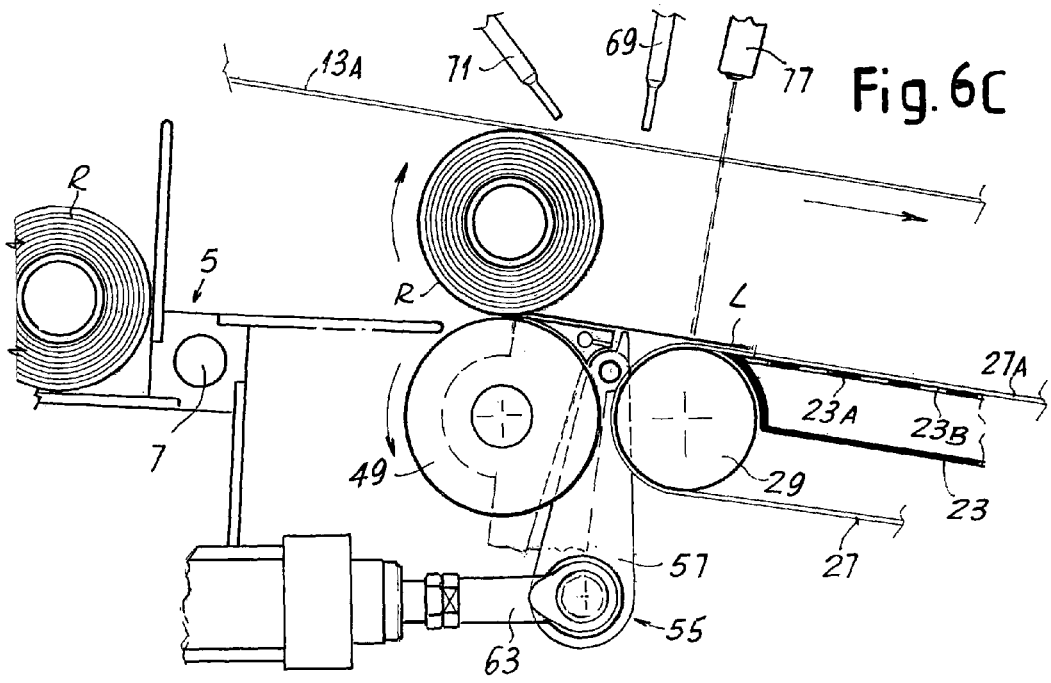
Figure 6D:
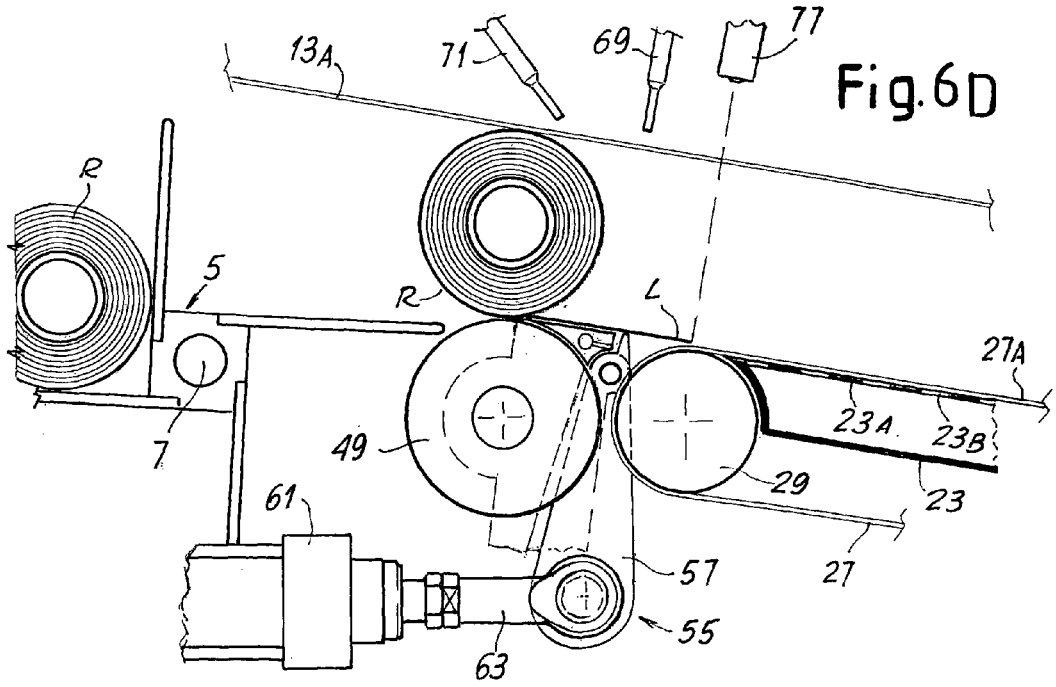
Figure 6E:
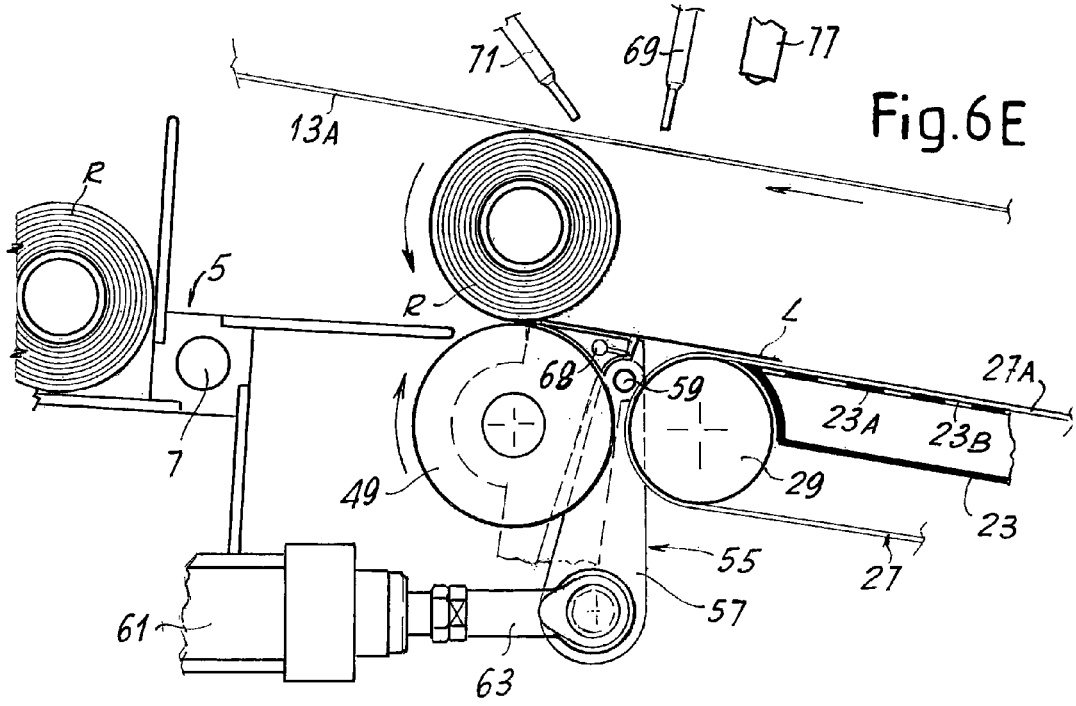
Figure 6F:
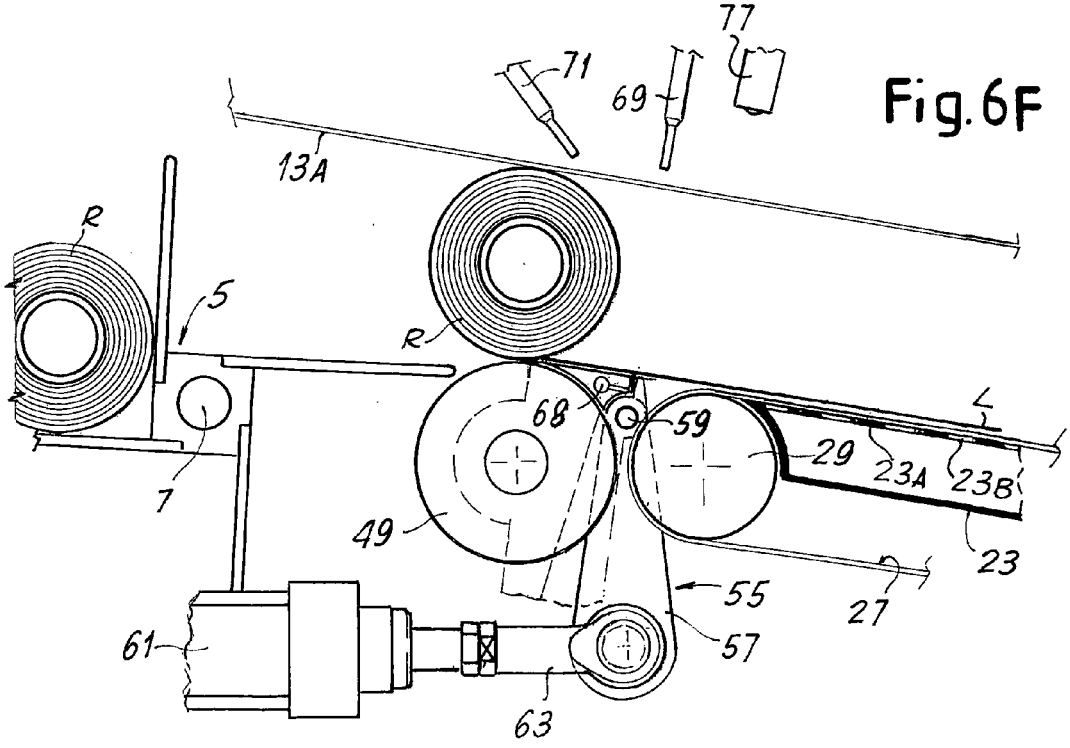
Figure 6G:
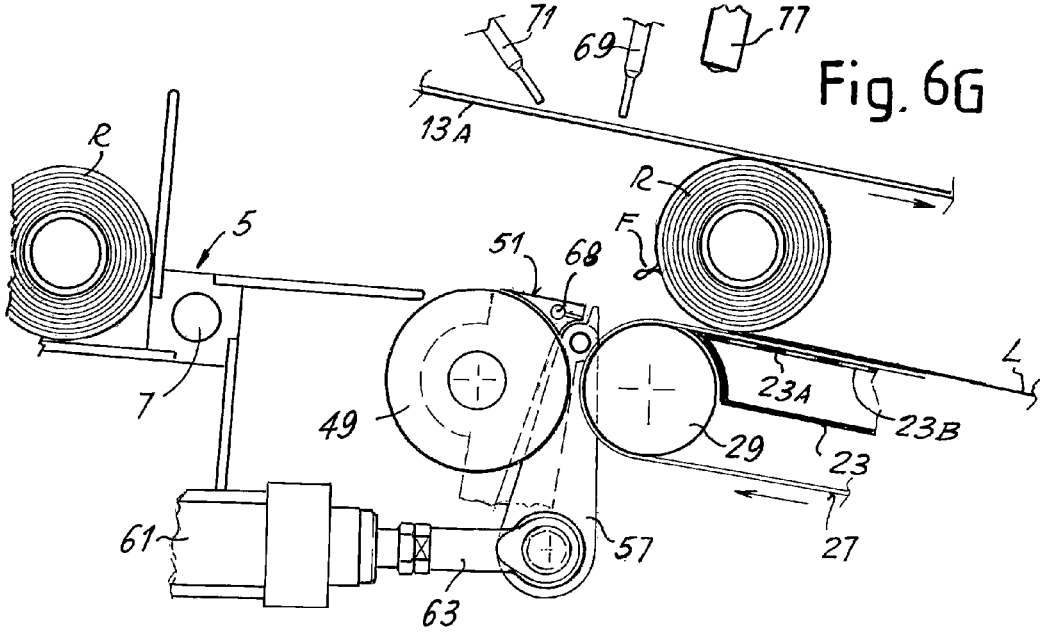
Figure 6H:
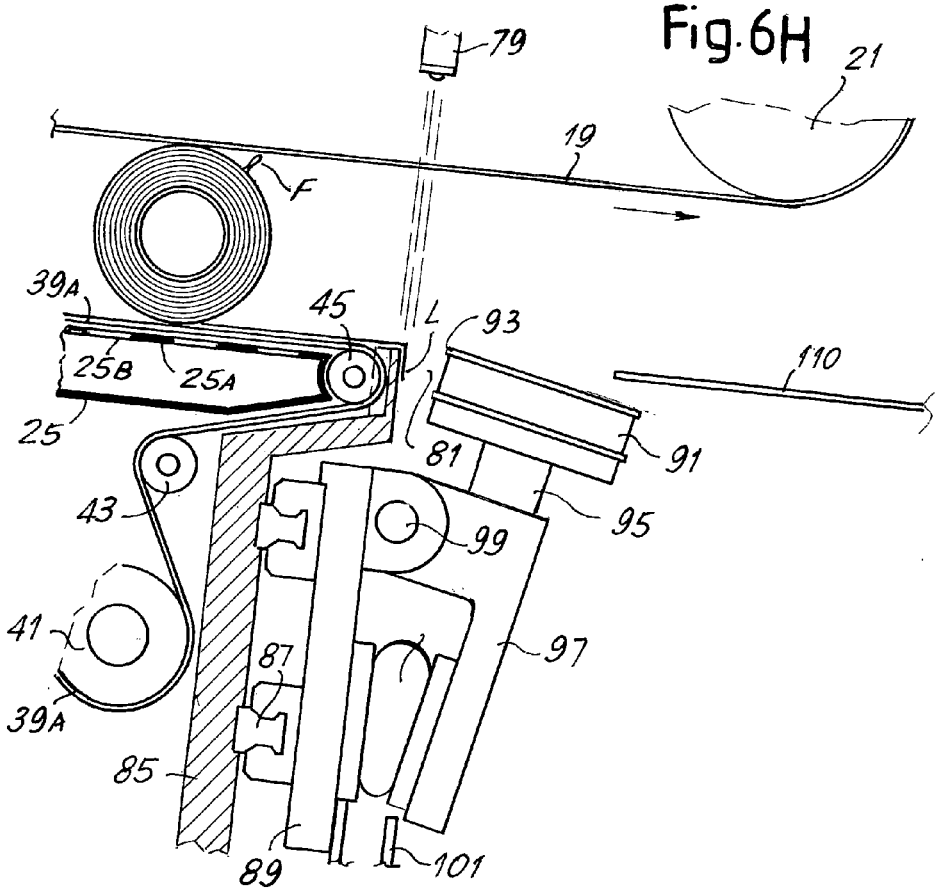

As shown in FIG. 6H, at the end of this advancing movement, controlled through the sensor 79, the log R is in proximity of the crossbar 83 with the tail end L under the rolling surface defined by the upper branch 39A of the lower flexible member 39. The tail end L is sucked downward by the suction present in this area.

Upon reaching this position, the lower flexible member 39A is stopped and the log R continues to advance rolling on the stopped upper branch 39A of the continuous flexible member 39 as a result of continuation of the movement of the upper flexible member 19, until the fold F previously formed and stabilized through the member 57 is positioned adjacent to the tail end L that in the meantime has been sucked by the suction member 101 into the compartment 81 against the crossbar 83.

Figure 6I:
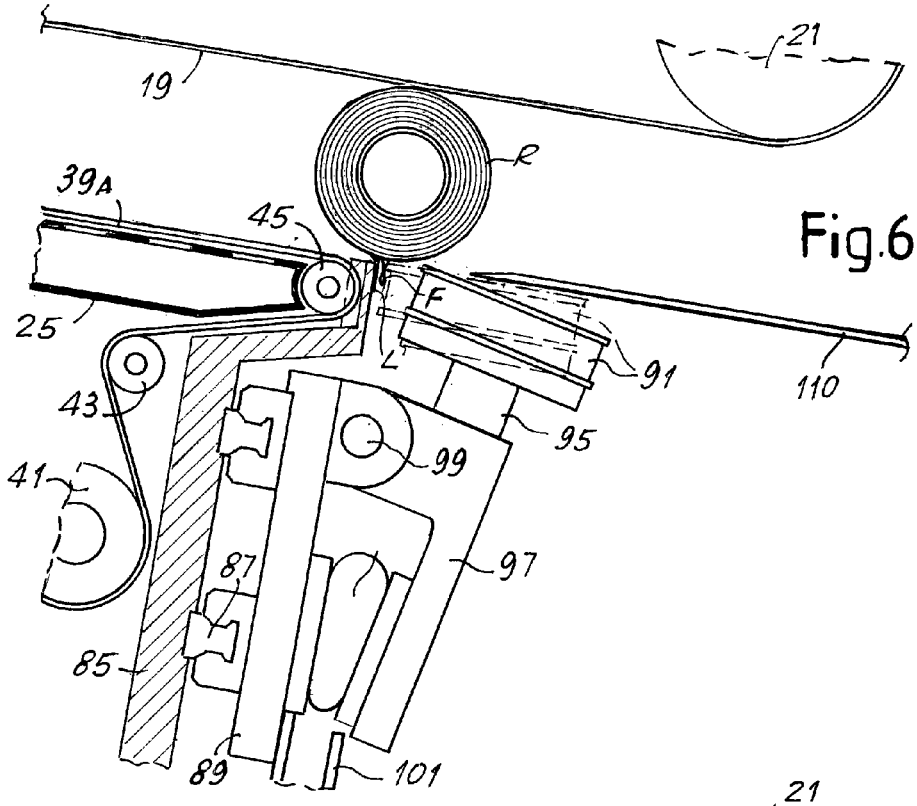
Figure 6J:
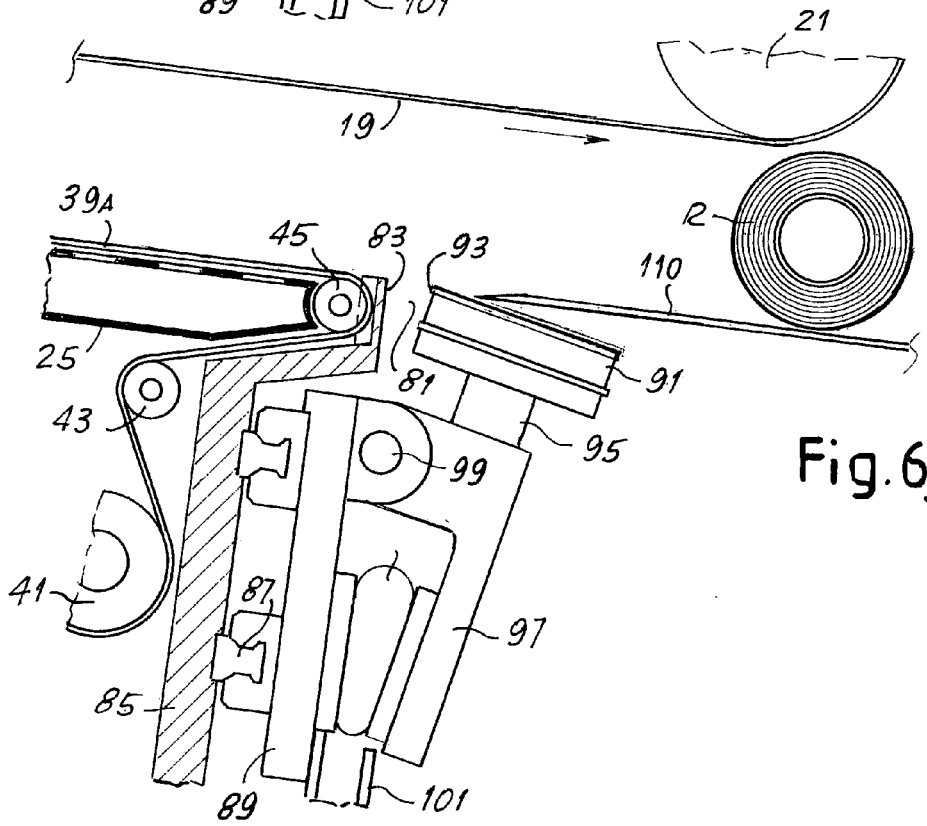

FIG. 6I shows the final position reached by the log R with the tail end L and the fold F thereof in the compartment 81 adjacent to the crossbar 83.

Upon reaching this position the actual closing of the tail end L takes place through mechanical ply-bonding or fastening performed with one of the pressure members described, for example the ply-bonding wheel 91 or the pressure members 103. If the wheel 91 is used, at this point it is made to oscillate to press with the annular edge 43 thereof against the crossbar 83 and moved transversely, i.e. orthogonally to the plane of the figures, to perform a stroke equal to approximately the width of the web material N, i.e. the axial length of the log R. Alternatively, a series of wheels placed side-by-side, spaced from one another and with a limited stroke with respect to the width of the web material, can be provided. The high pressure exerted by the annular edge 93 of the wheel against the counter surface defined by the crossbar 83 causes mechanical ply-bonding of the tail end L on the fold F. If the member 103 is used, mechanical ply-bonding takes place in the same manner as described with reference to stabilization of the fold F by the member 57.

As described with reference to stabilization of the fold F, instead of using localized pressure, bonding of the tail end L on the fold F can also take place through suitably shaped perforator members, such as needles or tips similar to those used for mechanical entanglement of nonwovens.

The log R with the tail end L mechanically fastened to the fold F is then discharged from the machine along a delivery chute 110 by means of the continuous flexible member 19 which, having performed mechanical ply-bonding of the tail end, starts to move again to control rolling and discharge of the closed log R.

Figure 7:
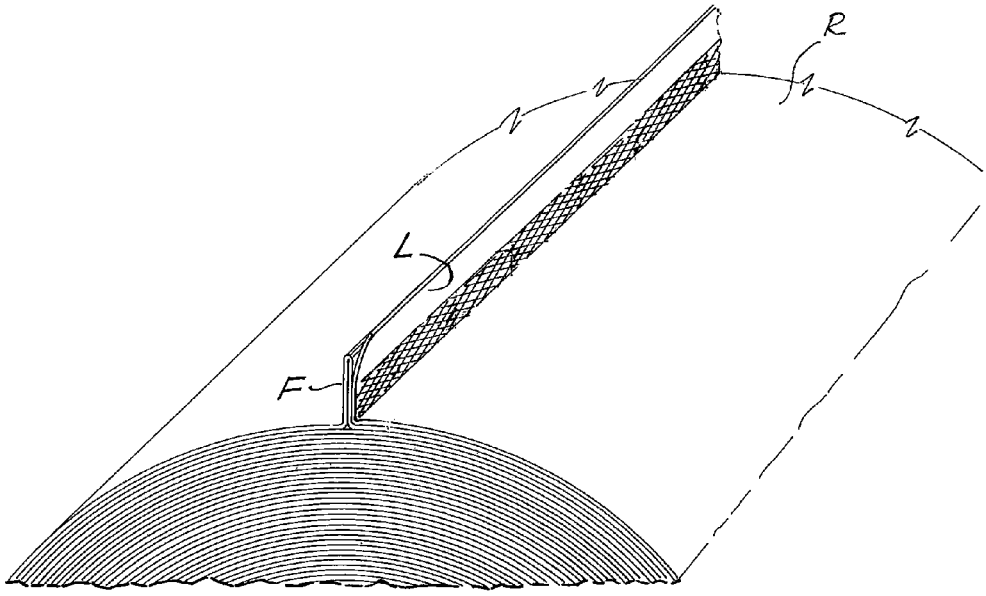
FIG. 7 shows a schematic perspective view of a log closed with the device according to the invention.

FIG. 7 shows an enlargement of the area of the fold F and of the tail end L fastened by means of mechanical ply-bonding on the fold F. In substance, projecting from the log R is a tab, having the length of the entire axial extension of said log R and formed of three layers: the two consecutive transverse strips or portions of web material that form the fold F and the tail end L mechanically coupled to this fold F.

In this way closing of the log R is obtained without using glue. This eliminates the drawbacks of using glue and advantageously produces an easily held tab, which the final user can grip to open the roll, thus avoiding both difficult operations to find the edge of the web material, and problems deriving from reciprocal gluing of a plurality of turns of the roll caused by seepage of the glue.

Figure 8A:
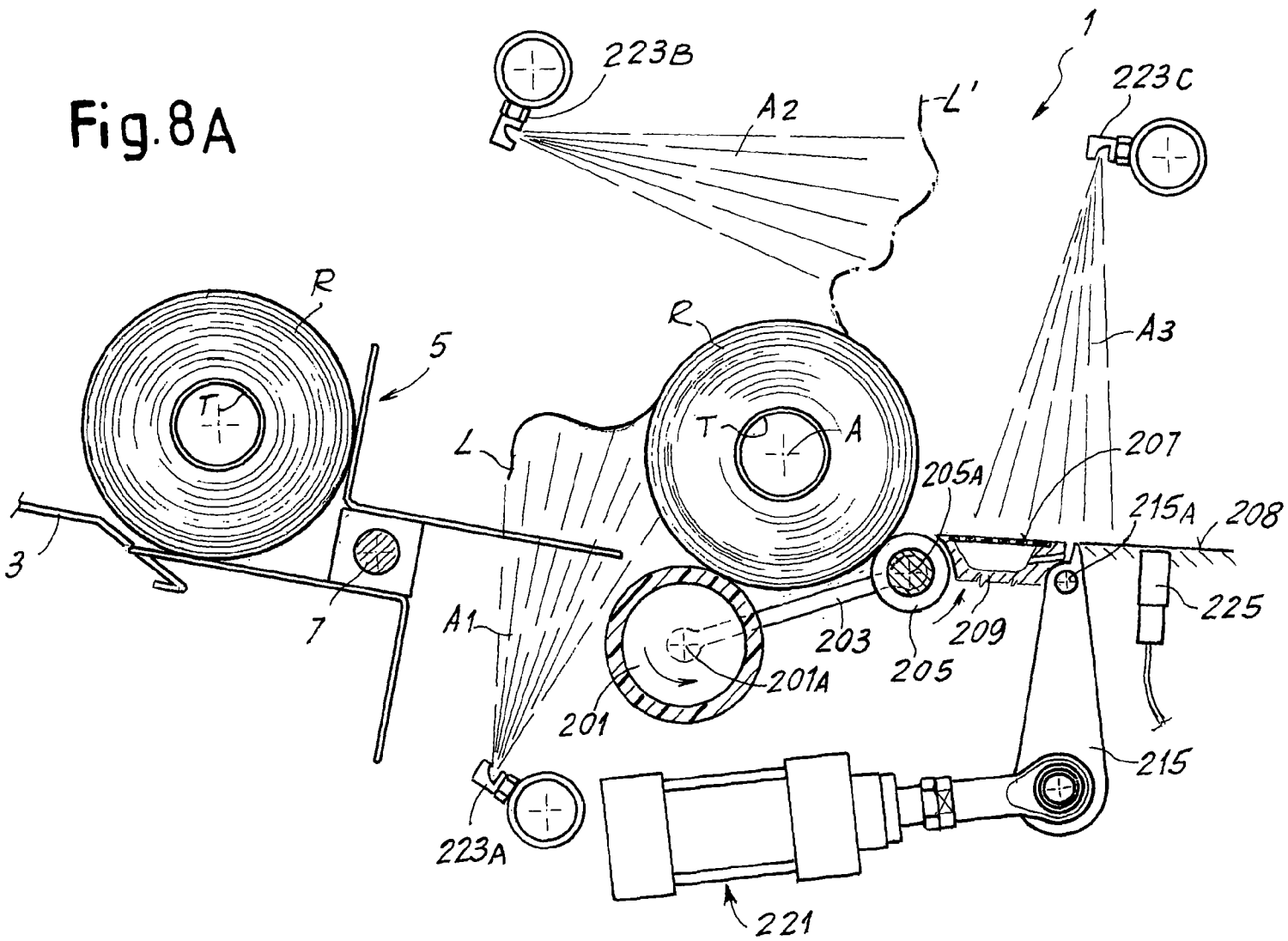
FIGS. 8A-8F show an operating sequence of a device according to the invention in a different embodiment.
Figure 8B:
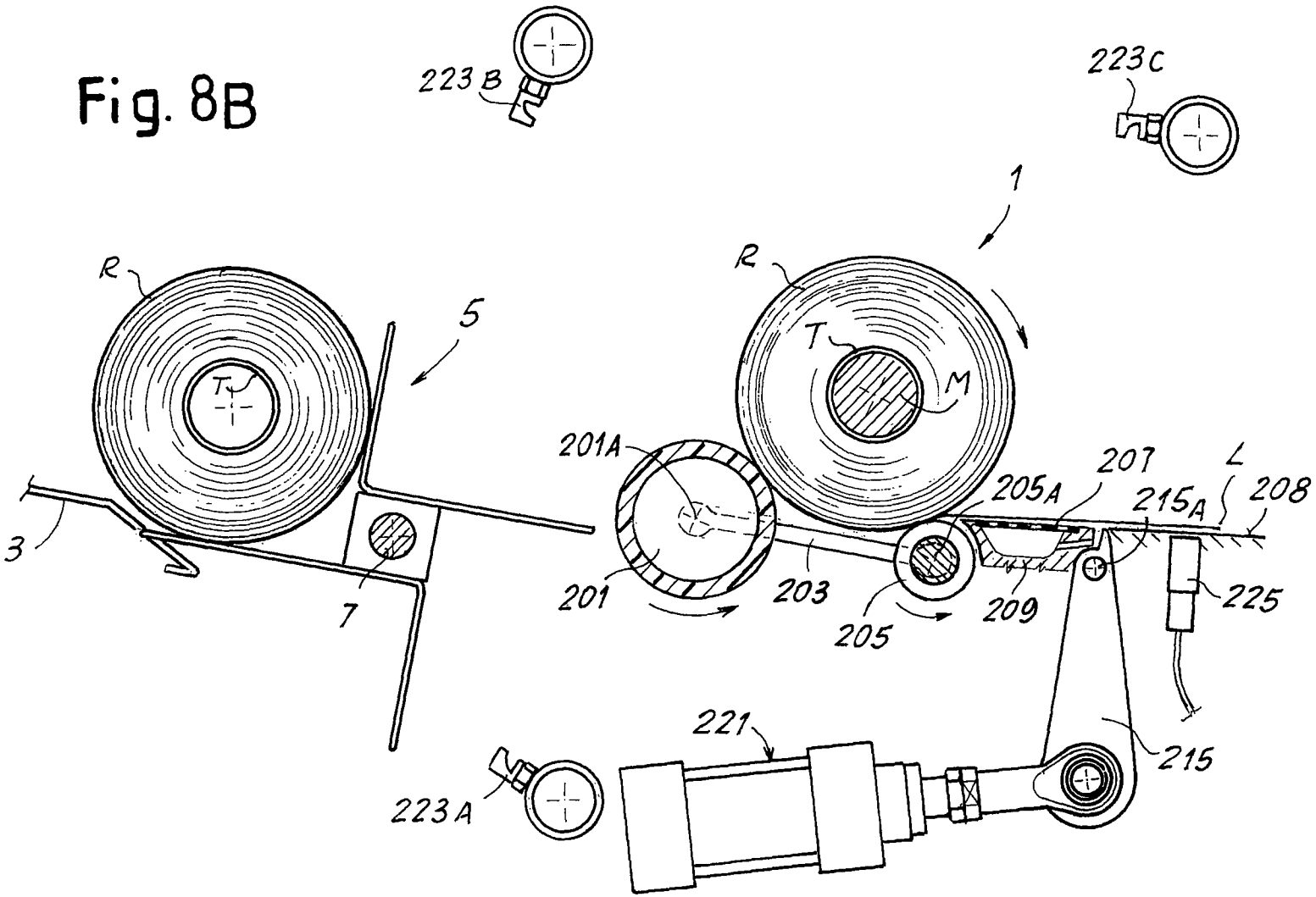
Figure 8C:
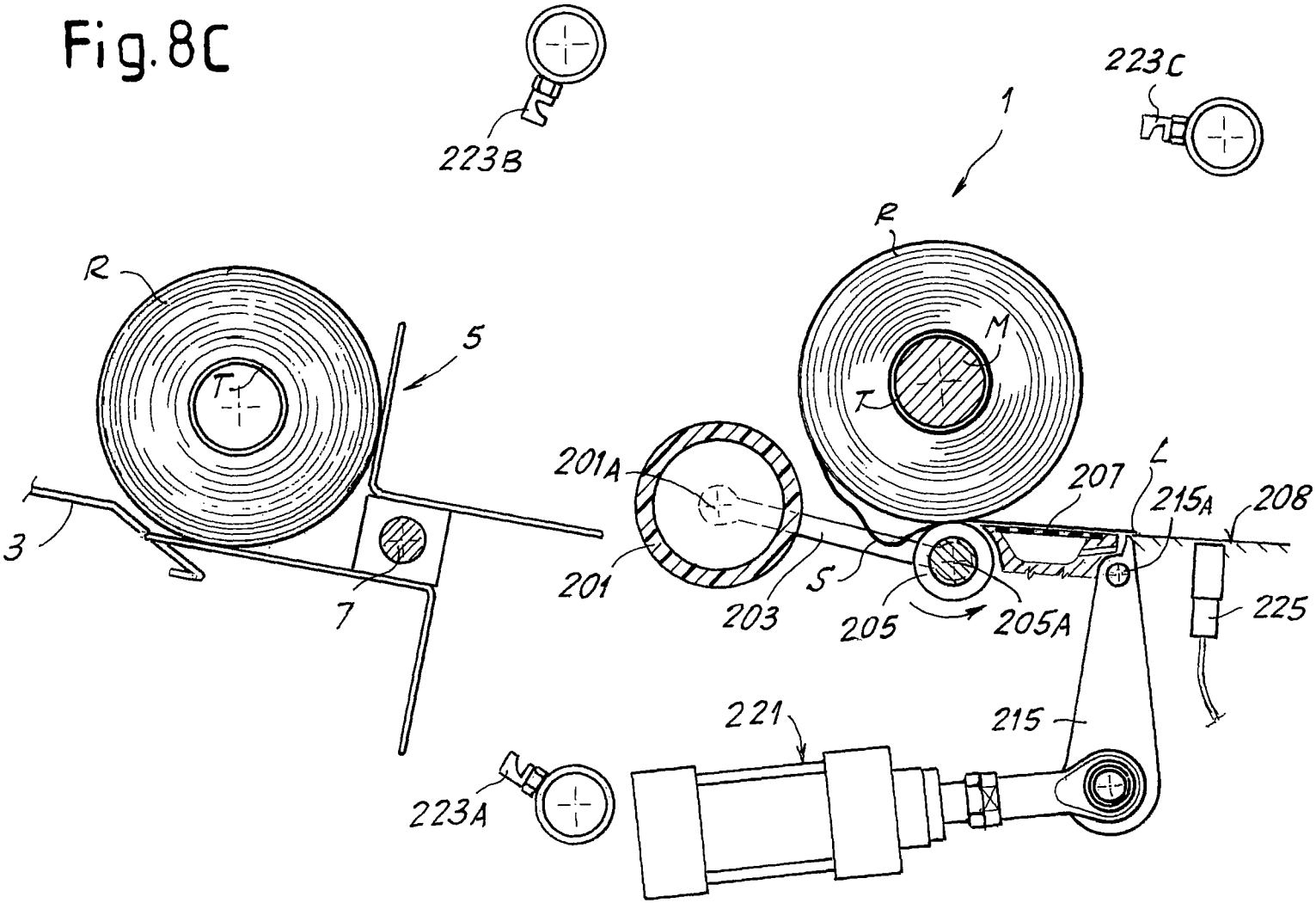
Figure 8D:
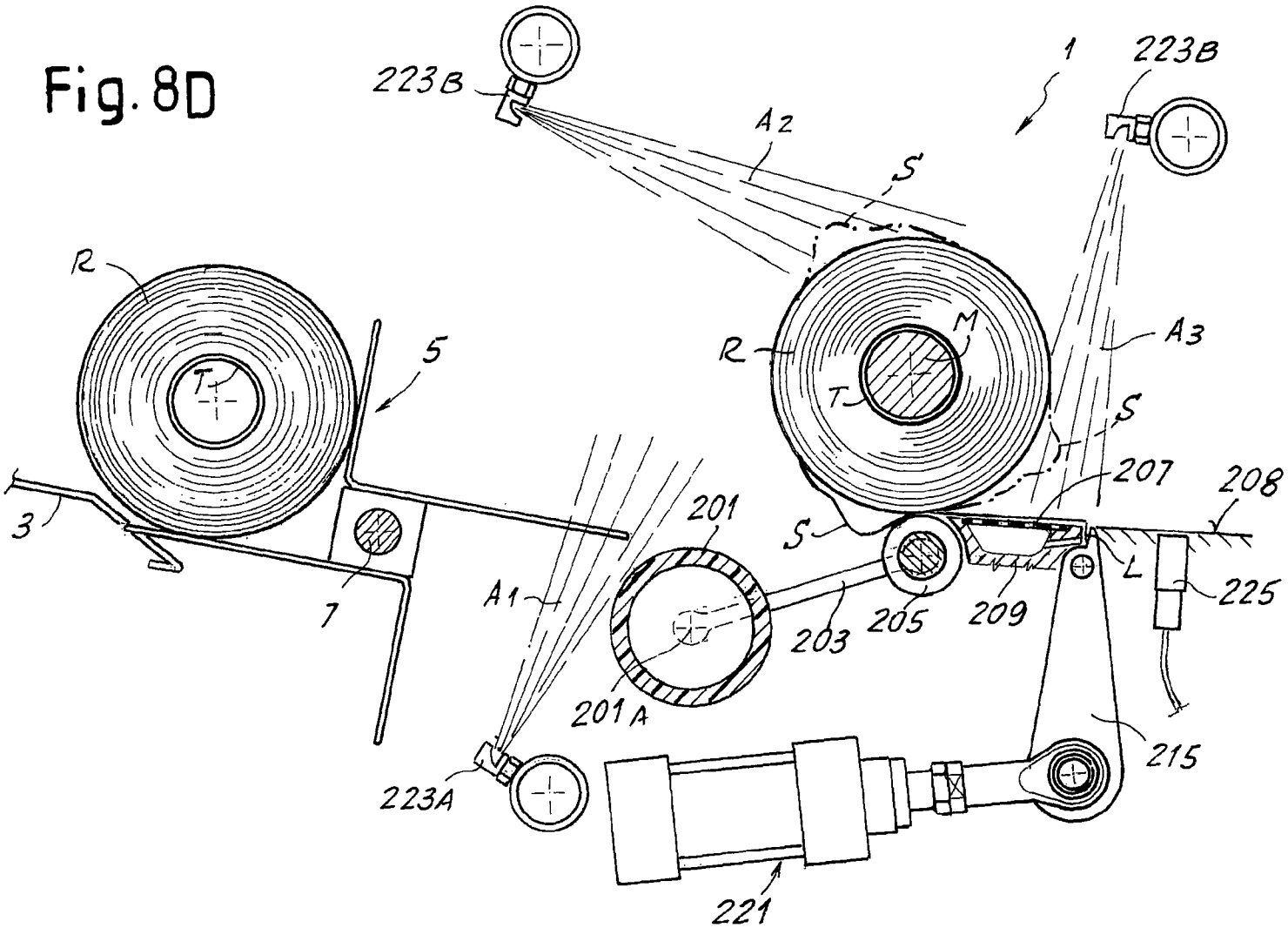
Figure 8E:
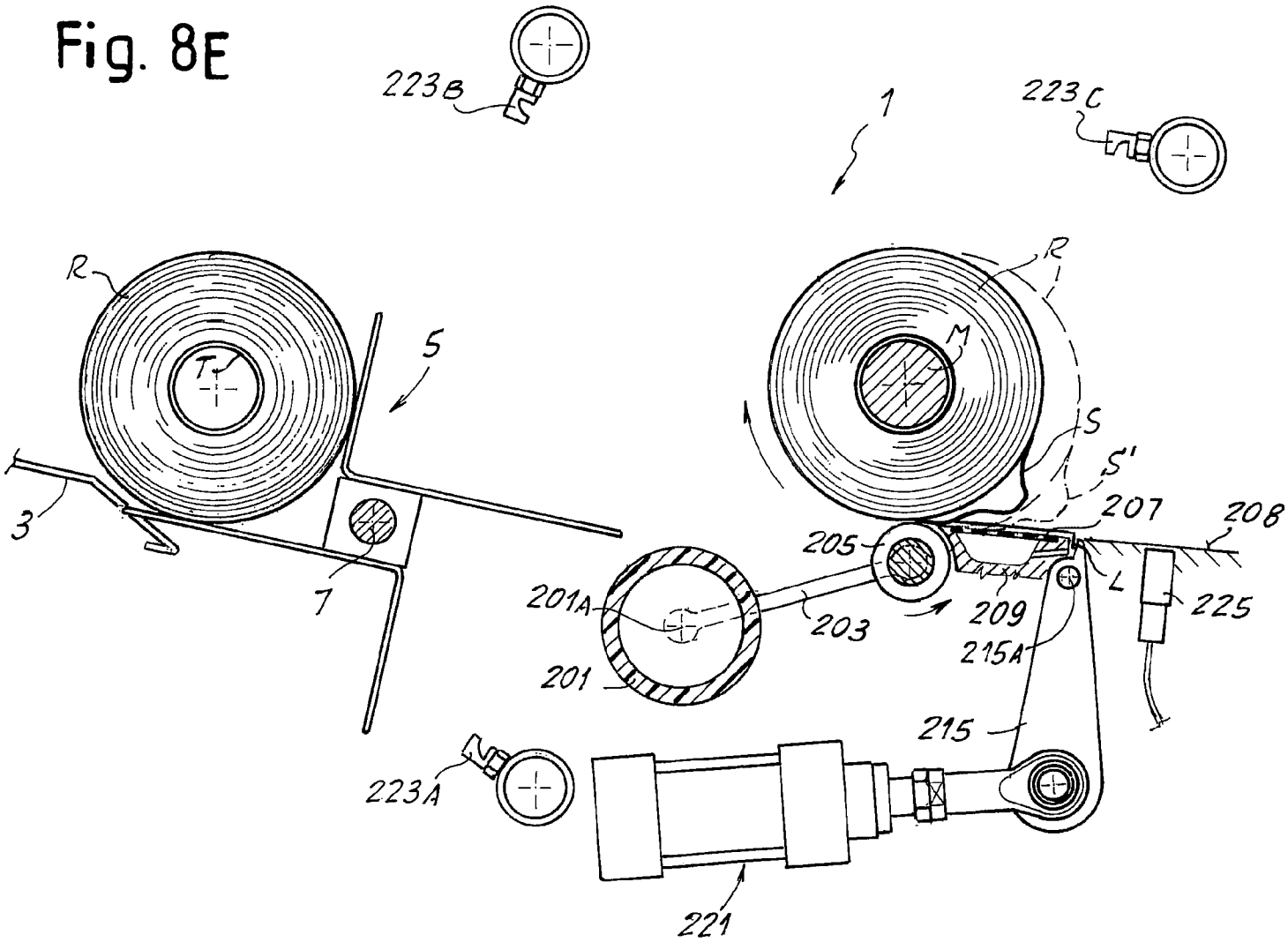
Figure 8F:
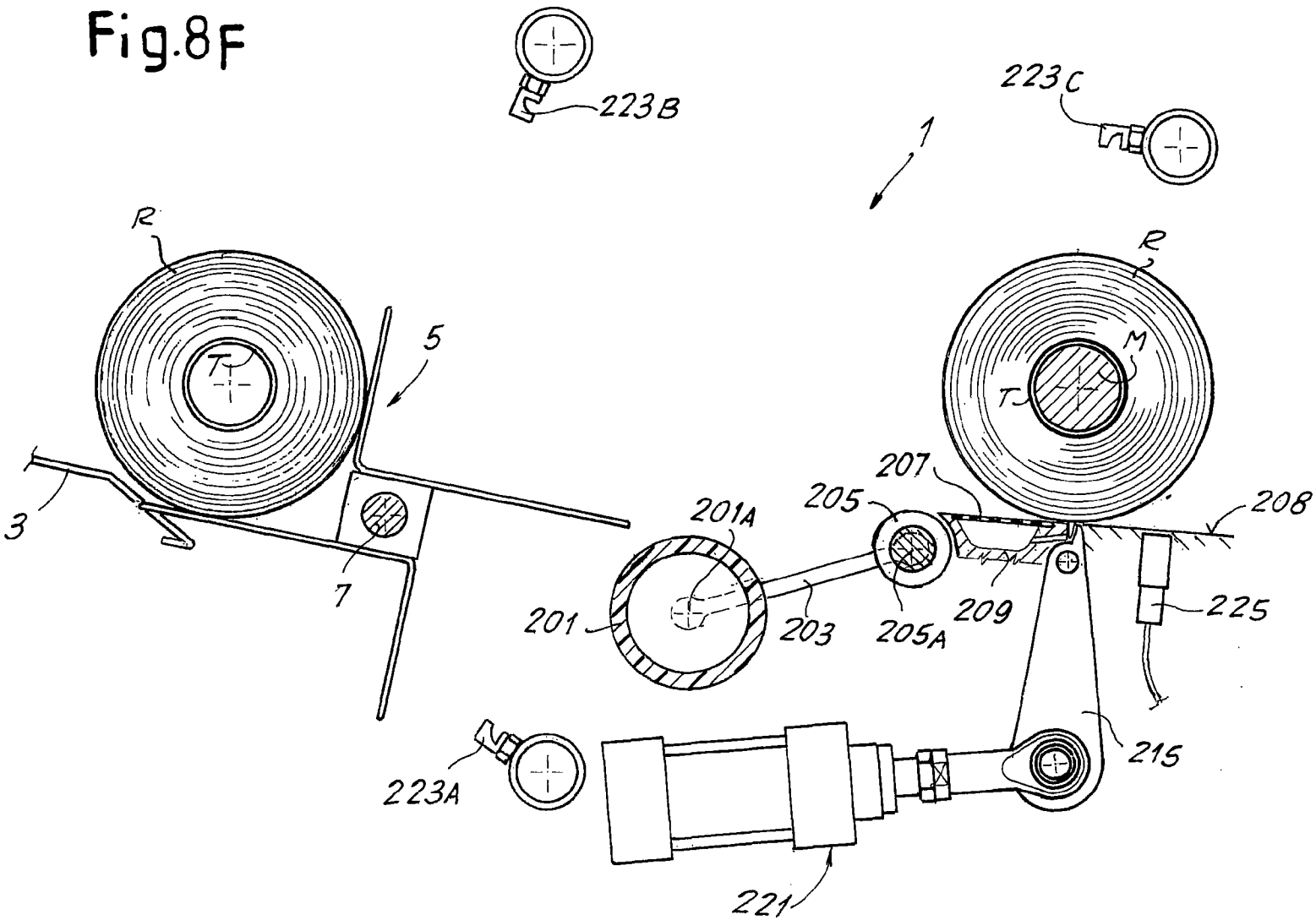
Figure 9:
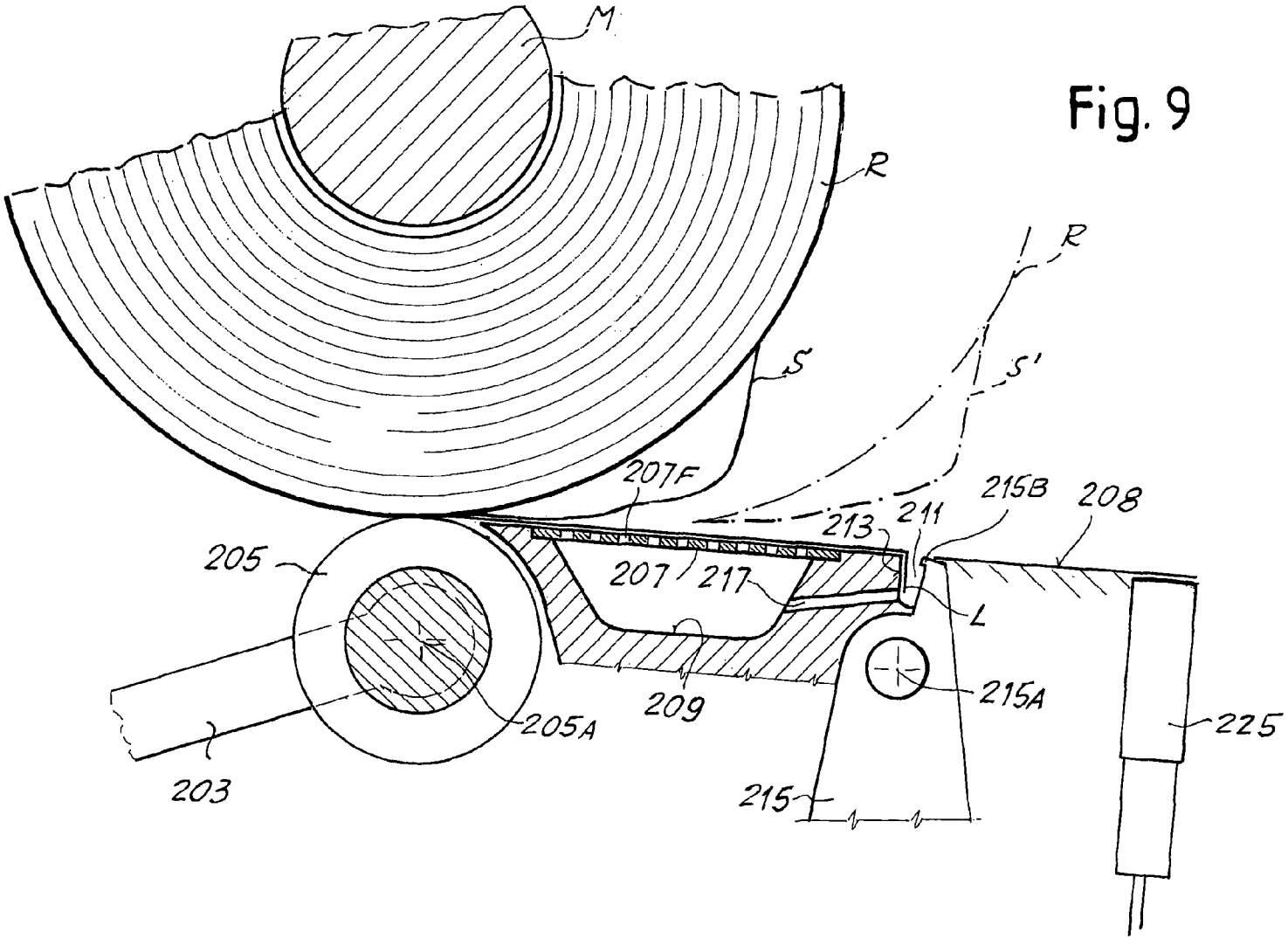
FIGS. 9 and 10 show enlargements of the device of FIGS. 8A-8F.
Figure 10:
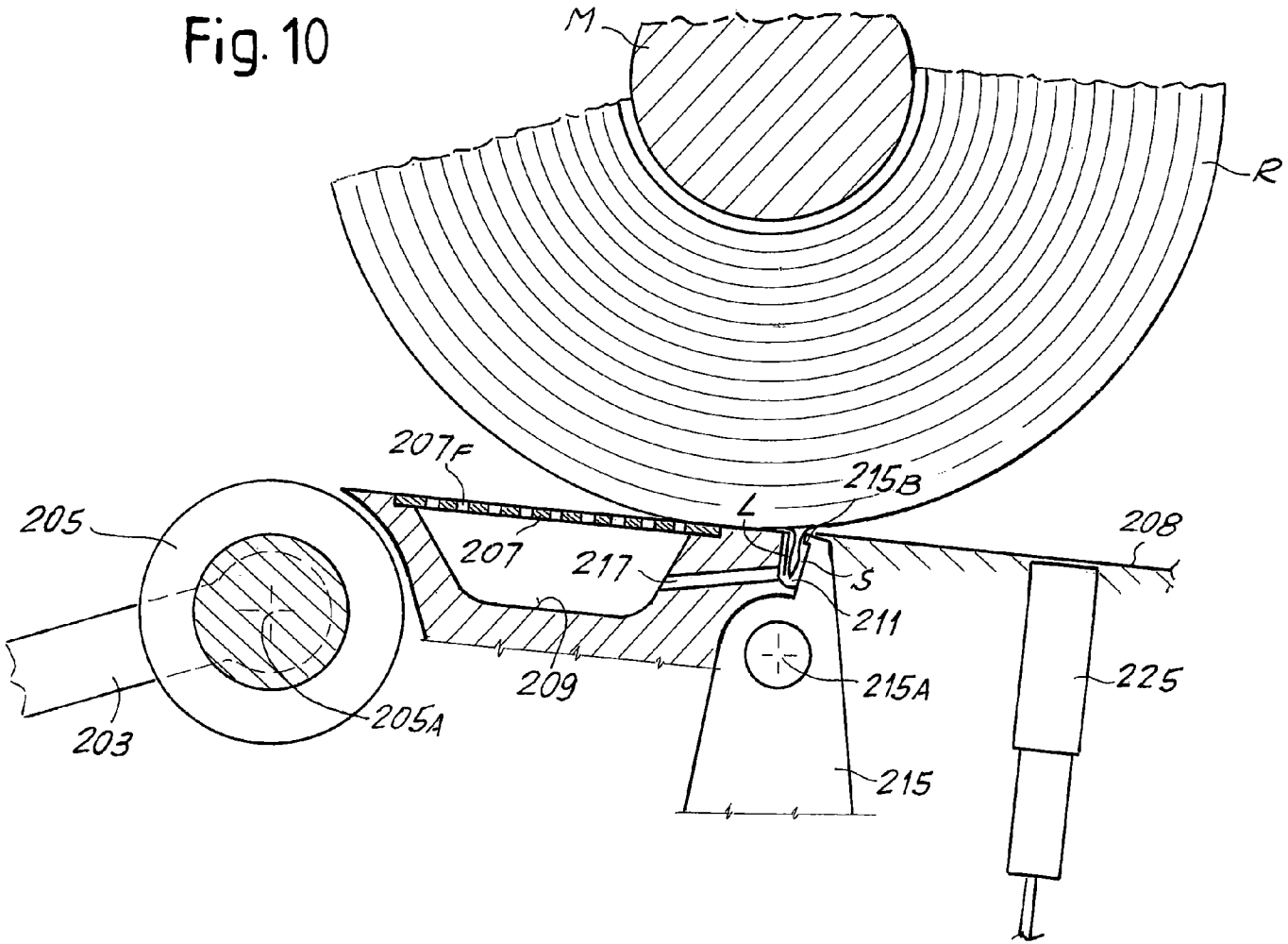

FIGS. 8 to 10 show a second example of embodiment of a machine and of a method according to the invention. In this example of implementation the device, again indicated as a whole with 1, comprises a feed chute 3 and a rotating distributor 5. The logs R to be closed are fed from the chute 3 and are picked up one by one by the rotating distributor 5 that rotates about a rotation axis 7, to transfer the single logs to a station for unwinding, rewinding and closing of the tail end.

Downstream of the rotating distributor 5 there is arranged a first roller 201 rotating in a controlled manner about an axis 201A and supported by an arm 203 pivoted about an axis of oscillation 205A that also forms the rotation axis of a second rotating roller 205. The rollers 201 and 205 define a cradle, into which each log R, the tail end L of which must be closed through the device 1, is discharged.

Downstream of the rotating roller 205 is arranged a surface 207. In one embodiment, the surface 207 is substantially flat. Advantageously, the surface 207 can be defined by an apertured wall that encloses a suction box 209 below. The holes 207F (see FIGS. 9 and 10) allow suction against the outer surface of the wall 207 of the tail end L and the web material adjacent thereto, unwound from the log R in the operating steps of the machine or device 1, described below in greater detail with reference to the sequence of FIGS. 8A to 8F.

Downstream of the surface 207 defined by the perforated wall that encloses the suction box 209 a cavity 211 is arranged, which extend below the surface 207 and an extension 208 of said surface 207. The compartment or cavity 211 is delimited in the area facing the suction box 209 by a wall 213 that defines a pressure surface against which a pressure member 215 acts.

In one embodiment the pressure member 215 is comprised of an oscillating arm or a plurality of arms oscillating about an axis 215A substantially parallel to the axes 205A and 201A. The reference 215B indicates teeth, tips or other elements with a small surface area, projecting from the oscillating arm or arms 215. The elements 215B can press against the counter surface 213 mentioned above as a result of an activation actuator 221 acting on the arms 215.

Under the area in which the teeth 215B and the surface 213 can interact suction holes 217 are provided, in communication with the inside of the suction box 209. Suction inside the box 209 thus generates a vacuum pressure inside the compartment 211 to draw the tail end of the web material against the surface 213 in the manner and for the purposes described below.

In one embodiment, series of compressed air nozzles 223A, 223B, 223C are arranged around a position of the log R defined by the cradle formed by the rollers 201 and 205. In each position there can be provided a single air knife 223A, 223B, 223C, or a series of nozzles aligned with one another according to a transverse direction with respect to the direction of advance of the logs, i.e. a direction substantially parallel to the axes 201A, 205A and 215A.

In one embodiment of the invention, along the surface 208 forming the extension of the surface 207 there is provided a sensor 225, for example a photocell or other appropriate sensor, suitable to identify the presence of a portion of web material above the surface 208. This surface is appropriately perforated to allow reading by the sensor 225. For example, an approximately central longitudinal slot can be provided along the surface 208.

The device described hereinbefore operates as follows.

In the step illustrated in FIG. 8A a log R has been discharged from the rotating distributor 5 into the cradle formed by the rollers 201, 205. In this step, the roller 201 is advantageously in a low position, with its axis 201A at a lower height with respect to the axis 205A of the rotating roller 205. The rollers 201 and 205 are rotated in the directions indicated by the arrows in FIG. 8A so as to make the log R rotate about its axis A maintaining the log in its position, i.e. with the axis A substantially stopped. The direction of rotation is such as to tend to wind the tail end L of the web material around the log R.

The nozzles 223A, 223B and 223C are activated to generate flows of compressed air A1, A2 and A3 respectively. The reference L indicates the tail end of the log R that is lifted by the jet or jets of air A1 generated by the nozzles of the unit 223A when the end L passes beyond the contact point between the log R and the motorized roller 201 and thus enters the area of action of the jet or jets A1. By continuing rotation of the log R about the axis A as a result of rotation of the rollers 201 and 205, the end L advances and enters the area of action of the nozzles 223B and therefore of the air jet or jets A2 and subsequently the area of the air jets A3 to be gradually unwound from the log R.

In FIG. 8A the reference L' indicates with a dashed line a subsequent position of the tail end L in the opening step. At the end of this operation the end L is on the surface 208 downstream of the photocell 225. The portion of web material between the tail end L and the point of detachment from the log R covers the surface 207, 208 and intercepts the beam of the photocell 225.

By continuing rotation of the rollers 201, 205 the portion of web material unwound by means of the jets of compressed air generated by the nozzles 223A, 223B, 223C is gradually rewound until the photocell 225 intercepts the tail end L. Winding can be interrupted at this point, or continued for a predetermined amount so that the tail end L moves toward the area of the compartment or cavity 211 below the surface 207, 208. Suction through the suction box 209 retains the portion of unwound web material on the perforated surface 207 and if necessary can suck the tail end L into this compartment 211, as shown in FIG. 9.

In FIG. 8B the log R is engaged by a pair of tailstocks, spindles, punches or other suitable elements, substantially coaxial with each other and with the log R, which are inserted from opposite sides into the winding core T of the log R. The reference M schematically indicates in cross-section one of these spindles in FIGS. 8B e 8C.

In one embodiment the tailstocks M can be motorized to rotate about the axis A of the log, drawing this log in rotation. In a different embodiment the tailstocks M do not rotate. In any case, the tailstocks M retain the log R in the position of FIG. 8C, in which the log has been carried by means of oscillation of the arms 203 and consequent lifting of the roller 201 with a movement about the axis 205A of the roller 205.

At this point a pouch or loop or pocket of web material is formed, indicated with S in FIG. 8C in one of the following ways. In a first possible operating mode the log R is held still by means of the tailstocks or spindles M, which in this case do not rotate, while the roller 205 rotates according to the arrow indicated in FIG. 8C (counter-clockwise in the example shown). A coating with sufficient friction coefficient of the roller 205 ensures that a certain quantity of web material is drawn back, i.e. upstream of the roller 205, sliding on the underlying turn of the log R.

If the machine operates according to this mode, in the previous step of positioning of the tail end, this end can have been stopped in a position slightly downstream of the compartment 211 under the surface 207, 208, i.e. in the position in which the photocell 225 is located, or for example between this and the compartment 211. In this way rotation of the roller 205 forms a pouch or pocket S of web material upstream of said roller by drawing back the web material downstream of the contact point of the roller 205 with the log R and thus moving the tail end L toward the compartment 211 by means of the suction generated by the suction box 209.

In a different operating mode the roller 205 can be maintained stopped while the log R is rotated counter-clockwise (in the example shown) by means of the tailstocks of the spindles M, which for this purpose are suitably motorized. In this case it is not necessary for the web material downstream of the contact point between the log R and the roller 205 to be drawn back and therefore the tail end L can have been positioned previously inside the compartment 211. In this case the roller 205 positioned under the log R is stopped and retains the web material in contact therewith, while rotation of the log R above caused by the tailstocks M (which in this case are motorized) loosens the last turn of web material making said last turn slide on the layer of web material that remains adhering to the roller 205 as a result of the high friction coefficient of the coating of this roller.

It would also be possible to combine the two operating modes described above in any case taking care to adequately control positioning of the tail end L so that, after the pouch, pocket or loop S has been formed, this end is positioned inside the compartment 211.

Maintaining the log R in the position shown in FIG. 8D, in which the pouch or pocket S that has been formed in the manner described above can be seen, the air nozzles 223A, 223B, 223C are then activated so that their jets A1, A2 and A3 gradually push the pocket or loop S as indicated in FIG. 8D until this pocket reaches the position S' in FIG. 8D.

In substance, the jets generated by the nozzles 223A, 223B, 223C push the loop or pocket S around the log R which is advantageously maintained temporarily stopped until said pocket passes from the rear part to the front part of the log R (with respect to the overall direction of advance of the log R through the device 1).

Subsequently, the log R is made to advance along the surface 207, 208 as shown in the sequence of FIGS. 8E and 8F, while the suction box 209 continues to suck air retaining the tail end L inside the compartment 211. This forward movement can be obtained by means of the spindles or tailstocks M and/or of the roller 205 or in any other manner, for example, also by positioning a belt or motorized roller or other movement system above the log R. Due to the gradual forward movement of the log R along the surface 207, the pocket or loop S is positioned over the compartment 211 and sucked inside by means of suction through the holes 217 by the suction box 209.

At a certain point, the log R is in the position shown in detail in the enlargement of FIG. 10, with the pocket or loop and the tail end L both retained by suction inside the compartment 211. Having reached this position, the oscillating arms 215 are made to oscillate to press with the teeth 215B against the counter surface 213, to exert a high pressure on the three layers of web material forming the tail end L and the pocket S that are located between the pressure surface 213 and the teeth 215B. The concentrated pressure exerted by the teeth 215B causes mechanical ply-bonding of these three layers with the consequent forming of a fold projecting from the substantially cylindrical lateral surface of the log R, joined in points, in segments or continuously to the tail end L with an effect substantially similar to that obtained with the machine described with reference to FIGS. 1 to 6.

The movement of the log R can then continue by spontaneous or controlled rolling along the surface 208 to a discharge area, not shown. The spindles or tailstocks M can be withdrawn at a suitable moment from the central core T of the log to allow discharge of the log R from the machine 1.

Various aspects of the device can be modified, for example by providing a different number of nozzles around the position in which the log R is located in the operating cycle described above. Moreover, it is also possible to use different mechanisms to control the forward and rolling movement of the log R in the various operating steps. Analogously, the system for pressure and mechanical ply-bonding of the tail end L to the fold formed by the pocket S can be different from the oscillating arm or arms 215. It would also be possible, for example, to use a ply-bonding wheel or a series of ply-bonding wheels in the same manner already described with reference to the example of embodiment shown in FIGS. 1 to 7.

What is important is that the log is controlled so as to position the tail end L inside the area in which this must be pressed against the fold formed by the pocket S of loosened web material and that, moreover, this pocket S is formed by loosening the last turn of web material and by providing suitable means that make the pocket of loosened material advance around the circumferential extension of the log.

With respect to the device described previously with reference to FIGS. 1 to 6, this device is more compact and equipped with a smaller number of mechanical parts and performs a faster cycle.

It is understood that the drawing only shows an example of embodiment of the invention, which can vary in forms and arrangements without however departing from the scope of the concept underlying the invention. Any reference numbers in the appended claims are provided to facilitate reading of the claims with reference to the description and to the drawing, and do not limit the scope of protection represented by the claims.

The invention claimed is:

1. A method to close a tail end of a log of web material comprising steps of:

unwinding a length of web material from the log;

at a distance approximately equal to or greater than a circumference of the log from a tail end of said length of web material unwound from the log, forming a fold in a portion of said length of web material, rewinding said length of web material, extending between said fold and said tail end, around the log, so that said fold projects from a surface of the log and is carried adjacent to said tail end;

joining the tail end to said fold projecting from the log by mechanical ply-bonding said tail end and said fold together in absence of an adhesive.

2. A method to close a tail end of a log of web material comprising steps of:

unwinding a length of web material from a log;

loosening a last turn of web material wound on said log to form in said last turn a fold projecting from the log at a distance approximately equal to or greater than a circumference of the log from a tail end of said last turn of web material of said log;

positioning said fold projecting from the log adjacent to said tail end;

joining the tail end to said fold by mechanical ply-bonding said tail end and said fold together in absence of an adhesive.

3. The method as claimed in claim 1, wherein said mechanical ply-bonding of the tail end of said log to said fold in said portion of web material of said log is by applying pressure to the web material or by perforation of the web material.

4. The method as claimed in claim 2, wherein said mechanical ply-bonding of the tail end of said log to said fold of said portion of web material of said log is by applying pressure to the web material or by perforation of the web material.

5. The method as claimed in claim 1, wherein said fold is formed such that said tail end and said fold are distanced by a length of web material approximately equal to a circumferential extension of the log.

6. The method as claimed in claim 2, wherein said fold is formed such that said tail end and said fold are distanced by a length of web material approximately equal to a circumferential extension of the log.

7. The method as claimed in claim 3, wherein said fold is formed such that said tail end and said fold are distanced by a length of web material approximately equal to a circumferential extension of the log.

8. The method as claimed in claim 1, wherein said mechanical ply-bonding of said tail end to said fold is by compressing said fold and said tail end between two mechanical members with sufficient pressure to provide bonding between superposed layers of web material.

9. The method as claimed in claim 2, wherein said mechanical ply-bonding of said tail end to said fold is by compressing said fold and said tail end between two mechanical members with sufficient pressure to provide bonding between superposed layers of web material.

10. The method as claimed in claim 1, wherein said fold is formed and stabilized by mechanically joining two adjacent transverse portions of web material before said joining of said tail end to said fold.

11. The method as claimed in claim 2, wherein said fold is formed and stabilized by mechanically joining two adjacent transverse portions of web material before said joining of said tail end to said fold.

12. The method as claimed in claim 10, wherein said two adjacent transverse portions are joined through applied pressure.

13. has been amended to read: The method as claimed in claim 11, wherein said two adjacent transverse portions are joined through applied pressure.

14. The method as claimed in claim 1, wherein the steps further comprise:

(a) said unwinding of said length of web material being along an unwinding surface;

(b) under said unwinding surface, forming the fold of web material in said length of unwound web material;

(c) rolling said log along the unwinding surface to rewind said length of web material around said log, with the fold projecting from the log;

(d) positioning the tail end of the web material side-by-side with said fold;

(e) carrying out said joining of the web material to the fold.

15. The method as claimed in claim 2, wherein the steps further comprise:

(a) said unwinding of said length of web material being along an unwinding surface;

(b) under said unwinding surface, forming the fold of web material in said length of unwound web material;

(c) rolling said log along the unwinding surface to rewind said length of web material around said log, with the fold projecting from the log;

(d) positioning the tail end of the web material side-by-side with said fold;

(e) carrying out said joining of the web material to the fold.

16. The method as claimed in claim 14, wherein said length of web material unwound from the log is retained on the unwinding surface by suction.

17. The method claimed in claim 15, wherein said length of web material unwound from the log is retained on the unwinding surface by suction.

18. The method as claimed in claim 14, wherein said fold is formed pneumatically.

19. The method as claimed in claim 15, wherein said fold is formed pneumatically.

20. The method as claimed in claim 14, further comprising pneumatically inserting said fold and said tail end in a transverse cavity under said unwinding surface, after said length of web material has been rewound around the log.

21. The method claimed in claim 15, further comprising pneumatically inserting said fold and said tail end in a transverse cavity under said unwinding surface, after said length of web material has been rewound around the log.

22. The method as claimed in claim 1, further comprising:

(a) said unwinding of said length of web material being along an unwinding surface;

(b) forming the fold of web material projecting from the surface of the log and positioning said fold under said unwinding surface adjacent to said tail end;

(c) providing said joining of the tail end of the web material to the fold by said mechanical ply-bonding.

23. The method as claimed in claim 2, further comprising:

(a) said unwinding of said length of web material being along an unwinding surface;

(b) forming the fold of web material projecting from the surface of the log and positioning said fold under said unwinding surface adjacent to said tail end;

(c) providing said joining of the tail end of the web material to the fold by said mechanical ply-bonding.

24. The method as claimed in claim 1, wherein said web material is paper.

25. The method as claimed in claim 2, wherein the web material is paper.

26. A method to close a tail end of a log of web material comprising steps of:

unwinding a length of web material from the log;

at a distance approximately equal to or greater than a circumference of the log from a tail end of said length of web material unwound from the log, forming a fold in a portion of said length of web material, rewinding said length of web material, extending between said fold and said tail end, around the log, so that said fold projects from a surface of the log and is carried adjacent to said tail end;

joining the tail end to said fold projecting from the log by mechanical ply-bonding said tail end and said fold together in absence of an adhesive to provide a tail edge projecting from the log wherein the tail edge is composed of three layers of adjoined web material.

* * * * *